United States Patent [19]

Bernhardt

[11] Patent Number: 4,511,888

[45] Date of Patent: Apr. 16, 1985

[54] DUAL SIGNAL ELECTROMAGNETIC ARTICLE THEFT DETECTOR

[75] Inventor: Terry L. Bernhardt, Scottsdale, Ariz.

[73] Assignee: U.S. Currency Protection Corp., Phoenix, Ariz.

[21] Appl. No.: 509,288

[22] Filed: Jun. 29, 1983

[51] Int. Cl.[3] ..... G08B 13/22; G08B 13/00

[52] U.S. Cl. ..... 340/571; 340/568

[58] Field of Search ..... 340/568, 571, 572

[56] References Cited

U.S. PATENT DOCUMENTS

| | | | |
|---|---|---|---|
| Re. 27,618 | 4/1973 | Robeson | 340/571 |
| 2,912,574 | 11/1959 | Gensel | 250/20 |
| 3,303,592 | 2/1967 | Harner | 42/1 |
| 3,424,122 | 1/1969 | DeAngelis | 116/2 |
| 3,769,593 | 10/1973 | Williams | 325/492 |
| 3,781,860 | 12/1973 | Freyling, Jr. | 340/571 |
| 3,828,341 | 8/1974 | Carter, Jr. | 340/571 |
| 3,999,137 | 12/1976 | Fucito | 328/167 |
| 4,015,224 | 3/1977 | Benzinger | 333/70 R |
| 4,109,239 | 8/1978 | Davis | 340/539 |
| 4,110,738 | 8/1978 | Sattin | 340/539 |
| 4,194,153 | 3/1980 | Masaki et al. | 455/31 |
| 4,195,263 | 3/1980 | Masaki et al. | 455/343 |

*Primary Examiner*—Glen R. Swann, III

*Attorney, Agent, or Firm*—Cahill, Sutton & Thomas

[57] ABSTRACT

A transmitter emits a pulsed radio signal and a digitally encoded radio signal near each exit of a protected premises. Monitored articles carry a receiver having a first circuit for receiving the pulsed signal, a power source, and a power switch for coupling the power source to a second circuit on detection of the pulsed signal. The second circuit receives the digitally encoded signal as multiple, serially-transmitted code bits. It also contains a clock for generating timing signals synchronized by the pulsed signal in order to distinguish a plurality of code bit intervals. A processor, an associated memory, and an address counter compare the digitally encoded signal with a stored bit pattern. On receiving an improper code bit, the processor causes the power switch to decouple the power source from the second circuit to conserve power. If the received signal matches the stored bit pattern, power is maintained to the second circuit. Alarm circuitry is triggered by overflow from the address counter. The address counter is reset each time the pulsed signal is received and thus produces no overflow, but when the article is removed from the protected premises, the address counter is allowed to overflow triggering the alarm circuit.

20 Claims, 13 Drawing Figures

DUAL SIGNAL ELECTROMAGNETIC ARTICLE THEFT DETECTOR

BACKGROUND OF THE INVENTION

1. Field of the Invention

The present invention relates generally to electronic security systems of the type used to detect the removal of an article, such as a bundle of currency, from a protected premises and, more particularly, to such a security system wherein radio signals are transmitted near the exits from the premises for actuating a receiver concealed within the article as it is removed from the protected premises.

2. Description of the Prior Art

Electronic security systems incorporating packets disguised as bundles of paper currency have long been used by banks and other financial institutions to help deter robberies and to assist in the apprehension of hold-up assailants and in the recovery of stolen money. One such electronic security system is described in U.S. Pat. No. 3,781,860, issued Dec. 25, 1973, entitled "METHOD AND APPARATUS FOR INHIBITING ARTICLE THEFT", and assigned to the assignee of the present invention. The security system described in the aforementioned patent includes a transmitter for transmitting first and second radio signals of different frequencies in the vicinity of each exit from the bank. A radio receiver is concealed within a hollowed-out packet resembling a strapped bundle of bills. Also concealed within the packet is a battery to power the receiver and one or more explosive squibs. Upon receiving the first and second signals, the receiver causes the battery voltage to be applied to these squibs, resulting in an explosion for disbursing tear gas, dust, smoke, and tracer dye from canisters also concealed within the packet.

The packets are normally maintained in teller drawers within the bank and are handed out to a robber by a teller during a robbery along with real bundles of money. As the robber leaves the bank, the concealed receiver is brought within the field of the transmitted first and second radio signals and is actuated thereby. Other patents disclosing related security systems are U.S. Pat. No. Re. 27,618 and U.S. Pat. No. 3,828,341, the latter of which discloses circuitry for preventing the squibs from being fired until the receiver packet has been removed from the vicinity of the bank exit to lessen the likelihood of the packet exploding within the bank premises.

One of the goals of prior art security devices of the type described above has been to minimize current drain from the battery within the receiver packet to extend required servicing intervals and to enhance the reliability of the security system. Attempts to minimize power drain from the battery have taken various forms, including the use of a switch normally biased in an open condition by a pin mounted in the teller cash drawer and extending into the currency packet through a small hole in the lower portion thereof, as taught in U.S. Pat. No. Re. 27,618. It has also been known in the art to incorporate a magnetic reed switch within the currency packet and to install a magnetic keeper plate within the teller cash drawer for normally biasing the magnetic reed switch in an open condition so long as the currency packet is disposed atop the keeper plate as disclosed within U.S. Pat. No. 3,828,341. Such prior art techniques suffer from the disadvantage of depending upon mechanical elements more subject to failure than electronic components.

The aforementioned U.S. Pat. No. 3,781,860, discloses a purely electronic power switch adapted to minimize the drain of power from the battery. Within the receiver circuit disclosed therein, a first receiver is continuously powered by the battery for detecting a first radio signal. A normally open power switch is interposed between the battery and the remainder of the components within the receiver circuit. Only after the first signal is received is the state of the power switch altered to electrically couple the battery to the remainder of the electronic components within the receiver circuit.

In addition to minimizing power drain on the battery within the receiver packet, another objective when designing currency packets for such radio controlled security systems is to minimize the possibility of the currency packet being falsely triggered by stray repetitive signals radiated from electro-mechanical and computer equipment often found within banks and other financial institutions. On approach toward minimizing the likelihood of such false triggering is disclosed within the aforementioned U.S. Pat. No. 3,781,860, wherein the receiver packet includes circuitry for receiving first, second and third frequency signals; the currency packet can be fired only if the first and second frequency signals are detected in the absence of the third frequency signal. Receipt of the third frequency signal is indicative of the presence of randomly generated noise, and the firing cirucit is then disabled to guard against false triggering. However, it has been found that, in rare instances, relatively narrow band width signals of the aforementioned first and second frequencies are radiated by equipment within the bank without also generating the third frequency disabling signal. In such rare instances, the currency packets have been known to be triggered even though not brought within the field of the signals intentionally transmitted near the bank exit. At least one manufacturer known to the present inventor is currently marketing such a security system utilizing digital coding techniques to further minimize the possibility of false triggering.

Of course, when designing such a security system, the size and number of components within the receiver packet must be minimized to be relatively compact and light-weight for being easily concealed within what appears and feels to be an ordinary packet of strapped bills. The receiver circuitry must consume little power to avoid excessive drain on the battery and yet be sufficiently sensitive to minimize "body shadowing" effects, i.e., reductions in the transmitted signal levels when the assailant's body is interposed between the transmitter and the receiver.

In such prior art security systems, it has been found desirable to incorporate filters within the receiver circuits to minimize the band width of signals detected by each such receiver in order to reject stray signals. Consequently, it has also been found necessary to carefully tune the transmitter frequencies at the factory to insure that the transmitted radio signals fall within the band widths detected by the corresponding receiver circuits. It has also been found necessary to periodically align the transmitter frequencies with the band width filters incorporated within the respective receiver circuits at periodic service intervals in view of frequency drift caused by aging of the frequency determining components.

Accordingly, it is an object of the present invention to provide such a radio-controlled security system which minimizes the drain of power from the battery while remaining highly sensitive to radio signals transmitted in the vicinity of the exits from the bank.

It is another object of the present invention to provide such a security system which minimizes the likelihood of the currency packet being falsely triggered by stray signals generated by electro-mechanical and/or computer equipment found in banks and other financial institutions.

It is still another object of the present invention to provide such a security system wherein frequency alignment of the transmitter at time of manufacture and at periodic service intervals is virtually eliminated.

It is a further object of the present invention to provide such a security system wherein the currency packet receiver circuitry is highly compact, lightweight, and relatively inexpensive.

It is a further object of the present invention to provide such a security system which minimizes the power requirements and physical size of the associated transmitter.

It is a still further object of the present invention to provide such a security system which utilizes a digitally coded signal and wherein the digitally coded signal may be easily and conveniently varied for a given user or as between several different users.

These and other objects of the present invention will become apparent to those skilled in the art as the description thereof proceeds.

SUMMARY OF THE INVENTION

Briefly described, and in accordance with one embodiment thereof, the present invention relates to a security system for detecting the removal of an article from a protected premises wherein the security system includes a transmitter for transmitting first and second signals in the vicinity of an exit from the protected premises as well as a receiver mechanism carried by the article. The first signal is transmitted as a series of periodic pulses transmitted at regular intervals. The receiver includes an electrical power source, such as a battery, as well as first and second receiver circuits for detecting the first and second transmitted signals, respectively. The first receiver circuit is continuously powered by the battery for detecting the first signal. A power switch is interposed between the battery and the second receiver circuit for selectively providing electrical power thereto. The first receiver generates an enabling signal upon detecting each transmitted pulse of the first signal, and the power switch is responsive to the enabling signal for energizing the second receiver circuit. Upon detecting the presence of the second signal, the second receiver circuit arms an alarm, such as a squib firing circuit used to discharge tear gas, dust, smoke, tracer dye, or the like. Upon failing to detect the presence of the second signal within a predetermined time period following the generation of the preceding enabling signal, the second receiver circuit generates a disabling signal to which the power switch is responsive for decoupling the second receiver circuit from the battery to minimize power drain until the receipt of a subsequent enabling signal.

In the preferred embodiment of the present invention, the first and second signals are transmitted in the form of electro-magnetic radio waves of first and second frequencies, and the first and second receiver circuits each include a filter for passing signals of the first or second respective frequencies.

Another aspect of the present invention relates to the aforementioned filter within the first receiver circuit, which filter minimizes power drain on the battery while providing high selectivity and sensitivity to the first frequency signal.

The aforementioned filter includes first and second current programmable operational amplifiers each having an inverting input terminal and an output terminal. A first feedback resistor of a first magnitude is coupled between the output terminal and inverting input terminal of the first current programmable operational implifier, while a second feedback resistor is coupled between the output terminal of the second operational amplifier and the inverting input terminal of the first operational amplifier. The ratio of the magnitudes of the first feedback resistor relative to the second feedback resistor approaches unity for increasing the sensitivity and selectivity of the filter. The first and second current programmable operational amplifiers are each operated at substantially the minimum possible current levels to minimize power drawn from the electrical power source, to minimize the band width of the gain provided by each of the first and second operational amplifiers, and to prevent the filter from oscillating due to positive feedback.

Still another aspect of the present invention relates to the transmission of the second signal as a plurality of serially coded bits following the transmission of each periodic pulse of the first frequency signal. The serially coded bits are transmitted during a corresponding plurality of successive code bit intervals. The second receiver circuit includes processing circuitry for storing a pattern of code bits and for comparing the serially coded bit received during each code bit interval with a corresponding stored code bit to determine whether they match one another. The processing circuit provides a clocking signal for each code bit interval and a data signal indicative of whether the proper code bit has been received for a given code bit interval. The power switch includes a clocked data latch responsive to the clocking signal and data signal provided by the processing circuit. The power switch further includes a transistor controlled by the output of the clocked data latch for selectively coupling electrical power to the second receiver circuit. The clocked data latch allows the aforementioned transistor to remain conductive provided that the proper code bit was received during the previous code bit interval; on the other hand, if an improper code bit is detected, the clocked data latch turns the transistor off and decouples the battery from the second receiver circuit. The clocked data latch is responsive to the enabling signal for rendering the power switch transistor conductive each time a periodic pulse of the first signal is received.

Still another aspect of the present invention relates to the use of the first signal to synchronize the operation of the second receiver circuit. The second receiver circuit includes a synchronizer responsive to the receipt of the first signal for synchronizing the generation of various timing signals which control the processing circuitry within the second receiver circuit. In the preferred form of the present invention, the synchronizer includes a master clock for generating a relatively high frequency periodic master clock signal and a synch-pulse generator responsive to the master clock signal and to the enabling signal for providing a reset pulse having a duration equal to one master clock period, which reset pulse is generated immediately following receipt of the enabling signal. The synchronizer further includes timing circuitry responsive to the master clock signal and responsive to the reset pulse generated by the synch-pulse generator for generating synchronized timing signals that are provided to the processing circuitry. The synch-pulse generator may include first and second clocked flip-flops each clocked by the master clock signal, the output of the first clocked flip-flop serving as the data input to the second clocked flip-flop, and the output of the second clocked flip-flop serving as the reset pulse.

A further aspect of the present invention is the use of a micro-processor for comparing the serially coded bits received by the second receiver to a bit code pattern programmed within a memory device associated with the micro-processor. An address counter provides an address which is sequentially modified each time a timing signal is received by the address counter. The address is provided to an addressable memory which, in response to the present address, provides an instruction. to the micro-processor. A series of instructions are provided to the micro-processor during each code bit interval for allowing the micro-processor to access the code bit received by the second receiver during each code bit interval and to compare the received serially coded bit to a corresponding stored code bit.

In a preferred embodiment of the present invention, the micro-processor includes an output terminal which generates a pulse whenever the micro-processor receives a particular instruction. The addressable memory is programmed to provide such an instruction to the micro-processor once during each code bit interval to provide such an output pulse for each code bit interval. This pulsed output terminal is coupled to the clock input of the above-referenced clocked data latch within the power switching circuit in order to update the power switching circuit following each code bit interval. The micro-processor also includes a data port for providing a data signal representative of whether a proper code bit was received during a particular code bit interval. The aforementioned data signal is stored by a clocked flip-flop, the output of which is coupled to the data input of the aforementioned clocked data latch within the power switching circuitry. Consequently, the power switching circuitry uncouples the power source from the second receiver circuitry and from the micro-processor and related components immediately following any code bit interval in which an improper code bit is received by the second receiver circuit.

The micro-processor may also include a further output terminal for providing a pulsed output signal whenever the micro-processor receives a corresponding instruction. The addressable memory is programmed to provide such an instruction to the micro-processor provided that the micro-processor has verified that all of the code bits received by the second receiver have been proper. The above-referenced further output terminal is coupled to the trigger input of a correct code latch which, upon receiving the pulsed signal provided thereto, causes the output thereof to change state. The output of the correct code latch is coupled to the above-referenced clocked flip-flop and forces the output thereof to remain in the state that maintains the power switch in a conductive state for continuously supplying power thereafter to the micro-processor and its related components.

A still further aspect of the present invention is the manner in which the above-described processor components are used to provide a hold-off mode of operation for the security system, i.e., preventing the alarm (explosion, smoke, tear gas, etc.) from being generated until such time as the article disguising the receiver circuitry is removed from the vicinity of the exit from the protected premises. The aforementioned address counter includes a reset input terminal which receives a reset signal each time the first receiver circuit detects the first signal transmitted by the transmitter. Thus, so long as the article disguising the receiver circuitry is within the field of the transmitter, the address counter is periodically reset. The address counter includes a high-order output terminal which is allowed to change state only when the address counter has been incremented to a predetermined number beyond that which may be reached between successive transmissions of the first signal transmitted by the transmitter. Consequently, the high-order output terminal of the address counter is prevented from changing state and triggering the alarm until the article is removed from the transmission field.

Another aspect of the present invention regards the use of a multiplexer coupling circuit having a first input terminal for receiving code bits stored within the addressable memory, a second input terminal coupled to the second receiver for receiving the serially coded bits received during the various code bit intervals, and a third input terminal for receiving a selector signal from the addressable memory. The multiplexer includes an output terminal for providing data to the micro-processor and selectively couples either the stored code bits or the received serially coded bits to the micro-processor under the control of the selector signal.

Still another aspect of the present invention regards the manner in which the first and second signals transmitted by the transmitter are generated. A clocking circuit within the transmitter generates first and second clocking signals of first and second frequencies, respectively. The clocking circuit also generates a third clocking signal having a period equal to the duration of one of the code bit intervals. The transmitter includes a counter which provides a code address that is incremented during each cycle of the third clocking signal. The code address is provided to pattern generating circuitry for providing first and second gating signals. The second gating signal incorporates the serially coded bit pattern to be transmitted by the transmitter. The transmitter also includes gating circuitry for receiving the first and second clocking signals and gating the same to a summing ouput under the control of the first and second gating signals, respectively. The summed output signal is in turn provided to an amplifier and radiated by an antenna in the vicinity of the exit from the protected premises.

Within the preferred embodiment of the present invention, the summed output signal is in the form of a voltage that switches between first and second non-negative voltage levels relative to ground potential. In order that the amplifier may receive a bipolar signal for amplification, a level translation circuit is provided at the input to the amplifier for shifting the summed output signal to a bipolar signal switching between positive and negative voltage levels relative to ground potential. To conserve power within the amplifier of the transmitter, a zero level control circuit is provided, responsive to the above-referenced first and second gating signals, for forcing the input of the amplifier to substantially ground potential whenever neither of the first and second clocking signals is gated to the summing output.

DETAILED DESCRIPTION OF THE PREFERRED EMBODIMENT

Figure 1:
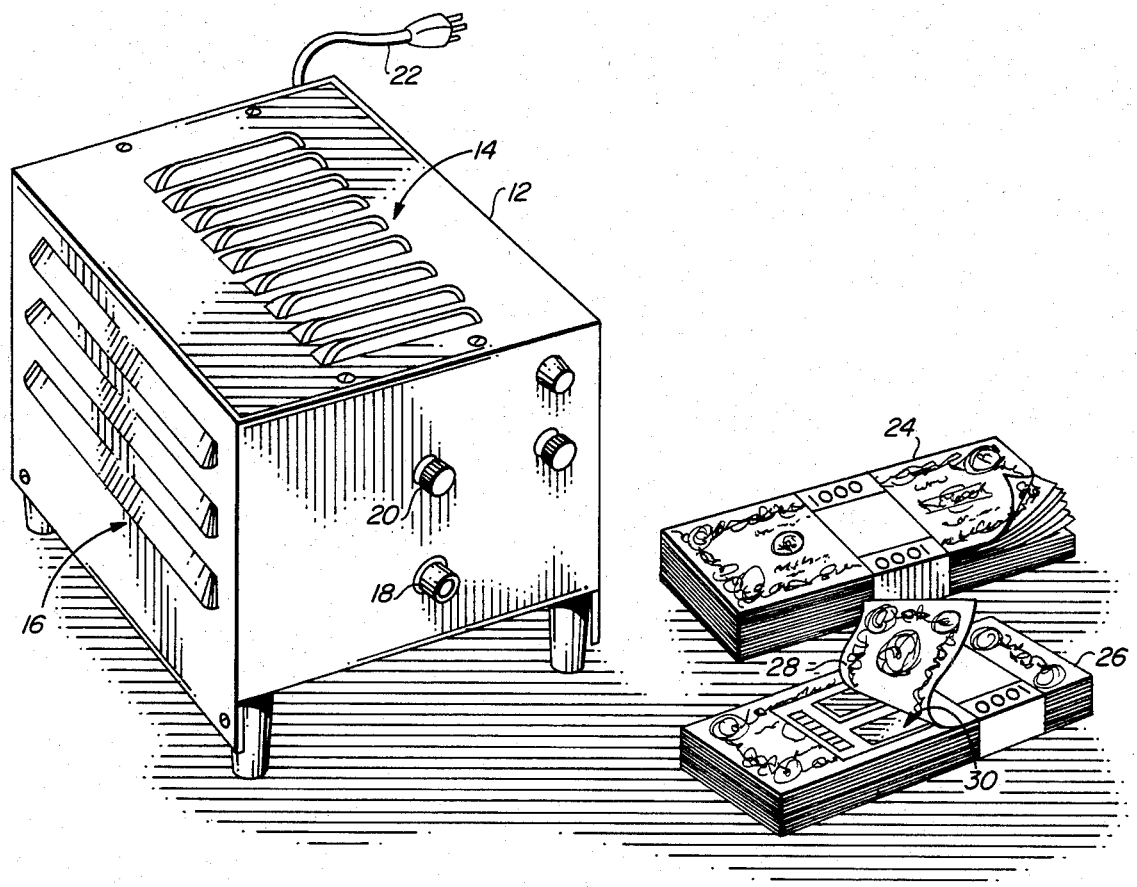
FIG. 1 is a perspective view of a security system of the type described herein and including a transmitter housing as well as a pair of receivers disguised as stacked and banded bundles of currency.

Within FIG. 1, a transmitter housing 12 contains the circuitry used to generate the radio signals transmitted in the vicinity of the exit or exits from the bank or other premises to be protected. Transmitter housing 12 includes a plurality of upper vents 14 and a plurality of side vents 16 for allowing air to freely circulate therethrough for allowing heat to dissipate therefrom. Transmitter housing 12 is also equipped with a coaxial cable connector 18 for providing an amplified output signal to one end of a coaxial cable, the opposite end of which would be coupled to one or more antennas disposed near each exit door. As is known to those skilled in the art, such antennas may take several forms, including frame antennas disposed about the frame of the door as well as mat antennas disposed on the floor of the bank immediately in front of an exit door. An output indicator light 20 is mounted upon transmitter housing 12 above coaxial cable connector 18 and indicates that an output signal is being provided thereto. A power cord 22 extends from transmitter housing 12 and is adapted to be plugged into a 110 volt AC outlet for supplying electrical power to the transmitter circuitry within transmitter housing 12.

Also shown within FIG. 1 are a pair of receivers 24 and 26 of the type used within the present security system. Receiver packets 24 and 26 outwardly appear to be conventional strapped bundles of currency, and actual currency bills may be inserted above and below the currency packet to simulate an actual bundle of currency. Currency bill 28 placed upon the upper portion of currency packet 26 is shown partly pulled away from the rest of packet 26 to reveal the electronic components forming the receiver circuit concealed within a hollowed out portion 30 of currency packet 26. The main body of receiver packet 26 may be formed of simulated currency; however, for added realism, the main body of receiver packet 26 is preferably formed of actual bills of currency which have had their center portions removed to form hollowed out portion 30. The weight of each receiver packet closely simulates the corresponding weight of a bundle of stacked bills, making detection by the assailant more difficult.

The receiver packet houses the electronic circuitry responsive to the signals transmitted by the security system, as well as a battery for powering the same; in addition, the receiver packet may contain one or more canisters containing tear gas, dust, rare earth oxide tracer, smoke, and/or dye which, under proper circumstances, are expended with sufficient force to rupture most containers in which an assailant is likely to place stolen monies. The receiver packets are normally maintained at each of the bank teller cash drawers and are handed out to an assailant at the time of a hold-up along with the rest of the hold-up money. Shortly after the assailant has left the bank premises, the tear gas, dust, tracer, smoke and dye are dispensed, aiding in the identification and capture of the assailant and in the identification of the stolen monies.

Figure 2:
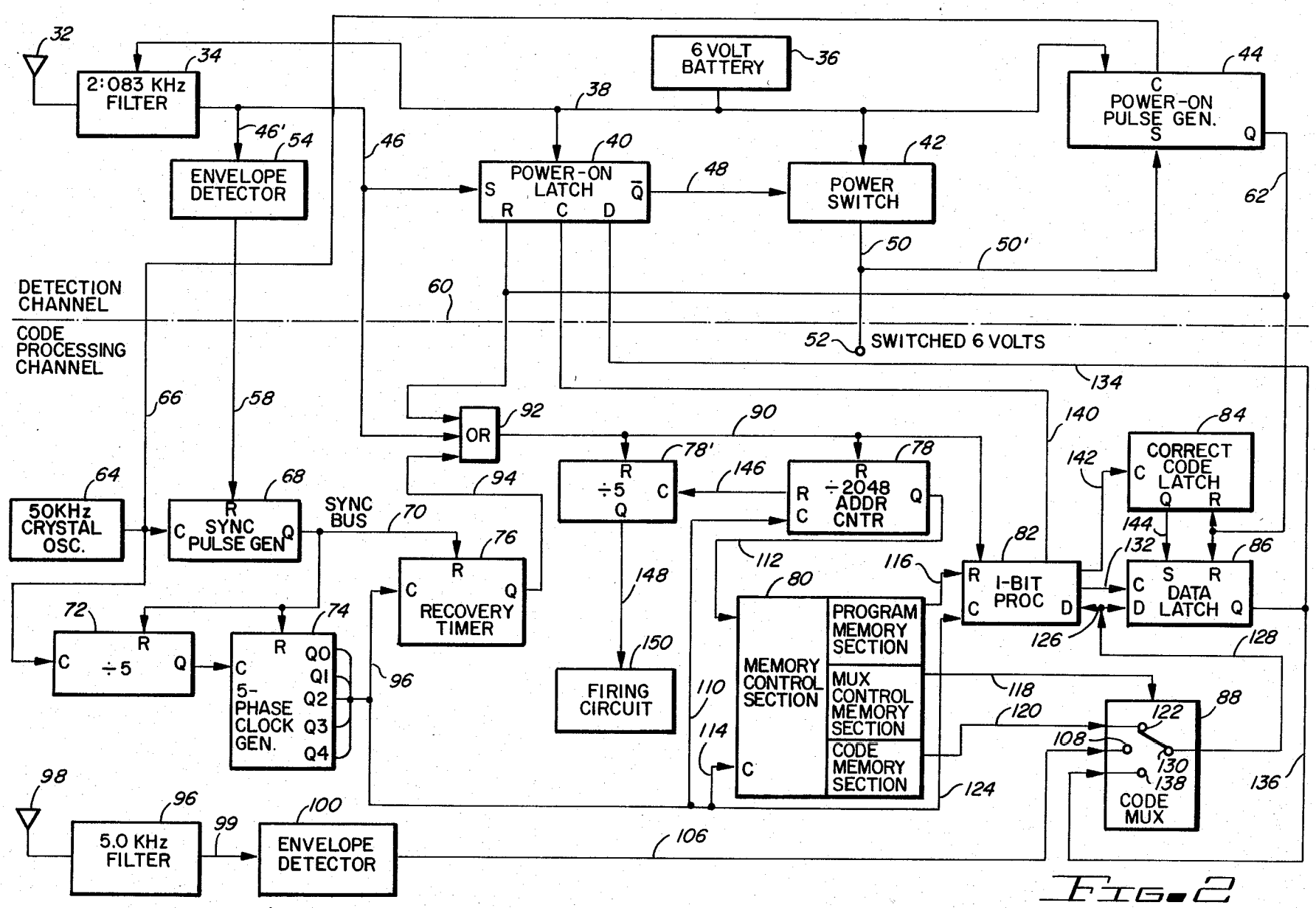
FIG. 2 is a block diagram of the receiver circuitry used within the preferred embodiment of the present invention.
Figure 3:
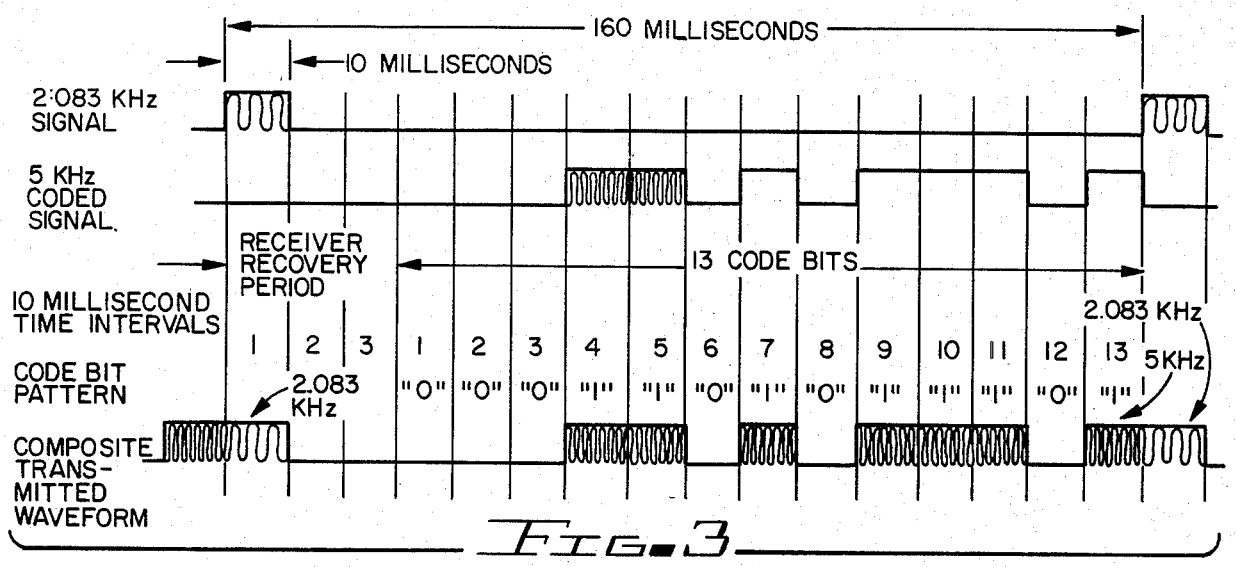
FIG. 3 is a timing diagram illustrating a first periodic pulsed signal, a second digitally coded signal, and a composite transmitted wave form incorporating the first and second signals.

Referring now to the block diagram of the receiver circuitry shown within FIG. 2, a first receiver includes antenna 32 and a first filter 34 coupled thereto. In the preferred embodiment of the present invention, a first signal having a frequency of 2.083 KHz is transmitted by the transmitter of the security system. Referring briefly to FIG. 3, the 2.083 KHz signal is shown as being transmitted for a ten millisecond duration every 160 milliseconds. Thus, the 2.083 KHz signal is modulated to provide a ten millisecond pulse every 160 milliseconds. Referring again to FIG. 2, filter 34 is a low power, narrow bandwidth filter which is responsive to and amplifies received signals having a frequency centered about 2.083 KHz while substantially blocking signals of other frequencies.

The receiver circuit shown in FIG. 2. also includes a six volt battery 36 coupled to a power supply conductor 38. As shown within FIG. 2, power supply conductor 38 is directly coupled to filter 34 for continuouslv supplving electrical power thereto. However, since filter 34 is designed to consume a small amount of current (i.e., in the tens of microamperes), very little power is ordinarily drained from battery 36 thereby. Power supply conductor 38 is also coupled to power-on latch circuit 40, power switch 42, and power-on pulse generator circuit 44. In the absence of the receipt of the 2.083 KHz signal, filter 34, power-on latch 40 and power-on pulse generator 44 continuously draw a total of only thirty microamperes from battery 36.

Still referring to FIG. 2, the output of filter 34 is coupled by conductor 46 to the set input of power-on latch 40. Upon first receiving the 2.083 KHz signal, the output of filter 34 provides a 2.083 KHz sinusoidal output which varies between approximately ground potential and +6 volts; this signal, when applied to the set input of power-on latch 40 by conductor 46, causes the $\overline{Q}$ output thereof to assume a high level. The $\overline{Q}$ output of power-on latch 40 is coupled by conductor 48 to a control input of power switch 42. Power switch 42 is responsive to the $\overline{Q}$ output of power-on latch 40 for electrically coupling power supply conductor 38 to a switched power supply conductor 50 whenever the $\overline{Q}$ output latch 40 is at a low voltage level or logic "0" (i.e., at or near ground potential). Conductor 50' extends from conductor 50 and is coupled to a control input (S) of power-on pulse generator 44. Conductor 50 is also coupled to a switched +6 volt power supply terminal 52.

The output of filter 34 is coupled by conductor 46' to the input of an envelope detector 54, the function of which is to demodulate the sinusoidal 2.083 KHz signal provided to the input thereof. Thus, when the receiver circuitry is within the presence of the 2.083 KHz signal transmitted by the associated transmitter circuitry, envelope detector 54 provides essentially a pulsed square-wave output as illustrated by the solid black lines designated 56 within FIG. 3. The modulated output wave form generated by envelope detector 54 is coupled to conductor 58, as shown in FIG. 2.

Collectively, filter 34, envelope detector 54, power-on latch 40, power switch 42, and power-on pulse generator 44 comprise a first detection channel constantly powered by 6 volt battery 36. This first detection channel is separate from a code processing channel of the receiver circuit which includes those components illustrated below dashed line 60 within FIG. 2. Upon receiving a 2.083 KHz signal, filter 34 provides an amplified sinusoidal signal to the SET input of power-on latch 40, repeatedly forcing the $\overline{Q}$ output of power-on latch 40 to assume a low level and, in turn, causing power switch 42 to assume its conductive state for coupling +6 volts to power supply terminal 52. Each of the code processing channel components shown within FIG. 2 is coupled to and selectively energized by switched power supply terminal 52.

The normally unenergized components within the code processing channel shown in FIG. 2 must be initialized each time they are turned on. To accomplish such initialization, power-on pulse generator 44 generates a reset pulse at its Q output each time that power switch 42 couples +6 volts to power supply terminal 52. The Q output of power-on pulse generator 44 is coupled by conductor 62 to the reset input of various components within the code processing channel to cause each of such components to be reset immediately following the application of electrical power thereto.

The code processing channel of the receiver circuit includes a 50 KHz crystal oscillator circuit 64 which serves as a master clock signal for the receiver circuit. The output of oscillator 64 is coupled by conductor 66 to a clocking input (C) of power-on pulse generator 44. Upon power switch 42 initially being switched to a conductive state, the positive transition coupled by conductor 50' to power-on generator 44 causes the Q output thereof to be set to a high level or logic "1". Shortly thereafter, however, oscillator 64 becomes energized and provides a clock pulse to power-on pulse generator 44, changing the output state thereof. Thus, the reset pulse provided by power-on pulse generator 44 has a duration approximately equal to the period of oscillator 64, or approximately 20 microseconds. As shown in FIG. 2, reset pulse conductor 62 is coupled to a reset (R) input of power-on latch 40; in this manner, it may be assured that power-on latch 40 is initially reset when 6 volt battery 36 is initially installed or subsequently replaced. While power-on latch 40 receives a reset pulse each time power switch 42 is switched to its conductive state, the effect of such reset pulse on power-on latch 40 is almost immediately negated by receipt of a positive peak of the sinusoidal wave form provided by filter 34.

Referring again to the code processing channel within FIG. 2, the output of oscillator 64 is coupled to the clock (C) input of a sync pulse generator 68, the purpose of which is to synchronize the generation of various timing signals utilized within the code processing channel. Sync pulse generator 68 includes a forced-state input, shown for simplicity as a reset (R) input within FIG. 2, coupled to conductor 58 for receiving the demodulated output of envelope detector 54. Upon receiving the leading edge of the pulsed signal shown as 56 within FIG. 3, sync pulse generator 68 forces its Q output to a low level or logic "0". The first clock pulse received from oscillator 64 following the above-described forced reset, causes sync pulse generator 68 to change the state of its Q output to a high level or logic "1". The second clock pulse received from oscillator 4, following the above-described forced reset operation, causes the Q output of sync pulse generator 68 to return to a low level; the receipt of additional clock pulses from oscillator 64 does not initiate further changes in the state of the Q output of the sync pulse generator 68. Thus, the Q output of sync pulse generator 68 provides a reset pulse having a duration equal to one period (20 microseconds) of oscillator 64 and is generated immediately following receipt of the leading edge of the demodulated signal provided by envelope detector 54.

The Q output of sync pulse generator 68 is coupled by conductor 70 to the reset input of divide-by-5 counter 72, to the reset input of 5-phase clock generator 74, and to the reset input of recovery timer 76. Counter 72, clock generator 74, and timer 76 generate the timing signals utilized within the code processing channel of the receiver circuit; by resetting each of these components under the control of sync pulse generator 68, it may be ensured that the code processing channel is properly synchronized with the signals being transmitted by the transmitter of the security system. Moreover, those skilled in the art will appreciate that the 2.083 KHz signal serves to synchronize the code processing channel for processing the 5 KHz serially-coded signal in a manner described below.

Figure 4:
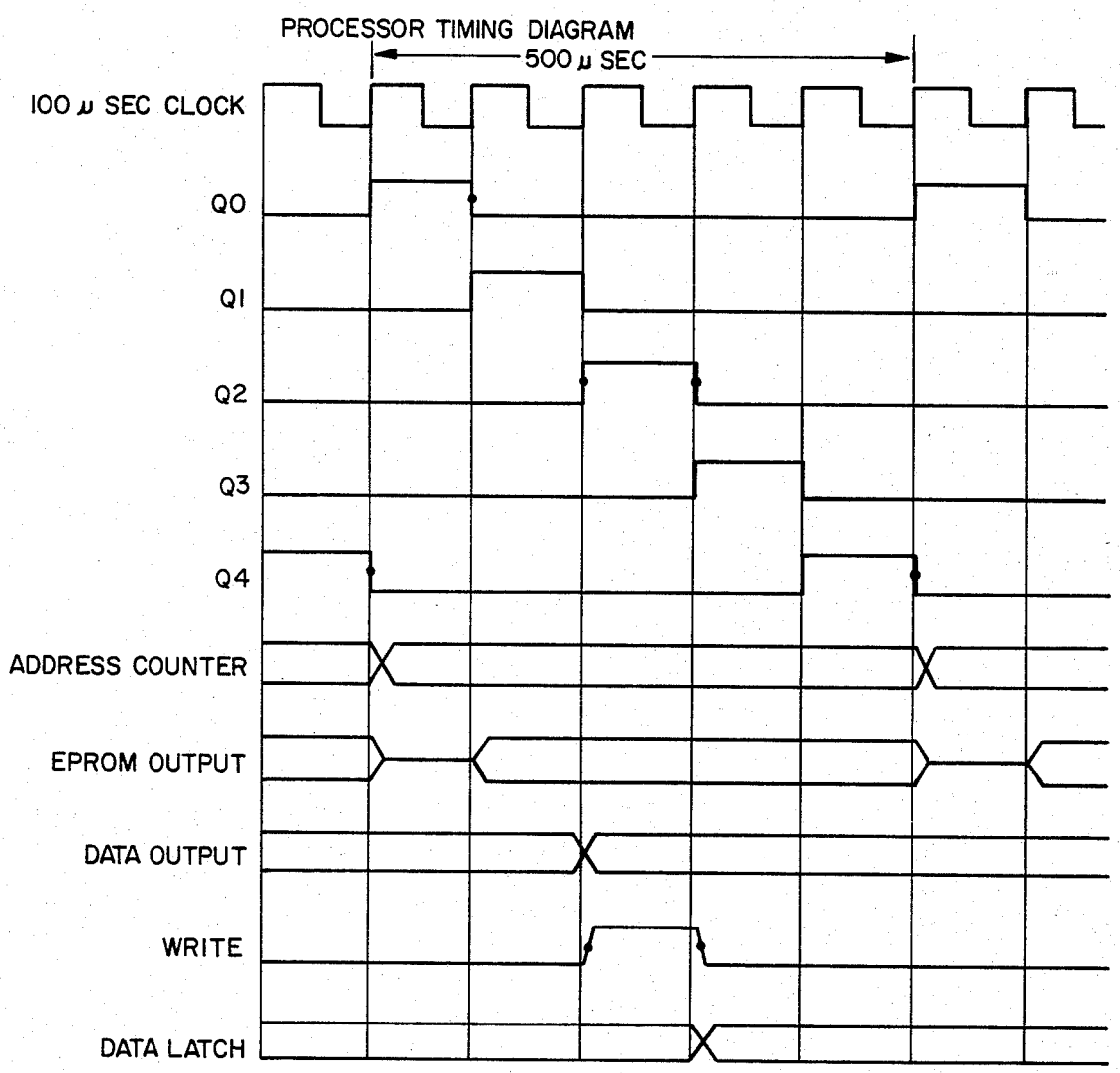
FIG. 4 is a timing diagram showing timing signals utilized by, and output wave forms generated by, processor circuitry within the receiver unit.

Still referring to FIG. 2, the clock (C) input of divide-by-5 counter 72 is coupled to the output of oscillator 64 for receiving therefrom the 50 KHz clocking signal. The Q output of counter 72 is coupled to the clock (C) input of clock generator 74 for providing a 10 KHz clocking signal thereto. Clock generator 74, in response to the signal received at its clock input, provides five phased clock output signals $Q_0$-$Q_4$ of which is provided once every 500 microseconds as a positive pulse having a duration of 100 microseconds, as shown in FIG. 4. Also shown within FIG. 4 is the 10 KHz clock signal provided at the output of counter 72.

Still referrring to the block diagram within FIG. 2, the code processing channel includes an address counter 78, an addressable read-only memory 80, a one-bit micro-processor 82, a correct code latch 84, a data latch 86, and a code bit multiplexer 88. The correct code latch 84 and data latch 86 each include a reset (R) input coupled to reset pulse conductor 62 for being reset each time that +6 volts is initially coupled to power supply terminal 52. Both correct code latch 84 and data latch 86 play a role in determining whether power switch 42 is retained in a conductive state, as will be explained more fully below.

Like correct code latch 84 and data latch 86, address counter 78 and processor 82 are reset each time that +6 volts is switched to power supply terminal 52. Address counter 78 and processor 82 each include a reset (R) input coupled to conductor 90 which, in turn, is coupled to the output of an OR gate 92. OR gate 92 has three input terminals, one of which is coupled to reset pulse conductor 62 for causing a reset pulse to be applied to conductor 90 each time power switch 42 is rendered conductive.

As mentioned above, recovery timer 76 is reset each time sync pulse generator 68 detects a leading edge of the demodulated wave form provided by envelope detector 54. Upon being reset, the $\overline{Q}$ output of recovery timer 76 switches to a high level or logic "1". The $\overline{Q}$ output of recovery timer 76 is coupled by conductor 94 to a second input of OR gate 92. Thus, when electrical power is switched to the code processing channel of the receiver circuit shown in FIG. 2, the reset pulse generated by power-on pulse generator 44 initially causes conductor 90 to assume a high level for resetting address counter 78 and processor 82, while recovery timer 76 continues to maintain a high level upon conductor 90 beyond the point in time at which the reset pulse provided by power-on generator 44 is terminated. Recovery timer 76 includes a clock (C) input coupled by conductor 96 to one of the phased clock output signals provided by clock generator 74. Recovery timer 76 is configured to count 60 clock pulses before causing its $\overline{Q}$ output to again assume a low level. Since recovery timer 76 receives one clock pulse each 500 microseconds, recovery timer 76 holds address counter 78 and processor 82 in a reset condition for 60 times 500 microseconds, or for 30 milliseconds, following receipt by recovery timer 76 of a synchronizing pulse from sync pulse generator 68.

Referring briefly to FIG. 3, it will be noted that the 30 millisecond period which follows the leading edge of waveform 56 is designated as a receiver recovery period during which no code bits are transmitted within the 5 KHz signal and during which the code processing channel is allowed to become initialized in preparation for processing 13 code bits to be transmitted serially over the following 13 code bit intervals. Each such code bit interval has a duration of 10 milliseconds. Thus, transmittal of the 13 code bits requires 130 milliseconds. The 30 millisecond receiver recovery period separates successive transmission of the 13 code bits, thus resulting in a 160 millisecond transmission cycle, as shown within FIG. 3. At the end of each receiver recovery period, conductor 90 is allowed to return to a low level for allowing address counter 78 to be incremented and to thereby initiate operations within the code processing channel for detecting receipt of the proper code bit pattern.

OR gate 92 within FIG. 2 includes a third input terminal coupled to conductor 46. The reason for the coupling of this third input terminal of OR gate 92 to conductor 46 is based upon the input thresholds of the circuitry utilized to implement the code processing channel within the preferred embodiment of the present invention. When the receiver of the security system is in an area of somewhat weaker field strength, the demodulated signal provided by envelope detector 54 may be of insufficient magnitude to exceed the input threshold of sync pulse generator 68 and thereby reset recovery timer 76; nonetheless, the lower input threshold of the third input terminal of OR gate 92 will be exceeded for generating a high level on conductor 90.

Still referring to FIG. 2, the code processing channel of the receiver circuit includes a 5 KHz filter 96 selectively powered by power supply terminal 52 and adapted to amplify a 5 KHz signal received at antenna 98. The 5 KHz sinusoidal signal passed by filter 96 is coupled to the input of an envelope detector 100 which demodulates the 5 KHz signal. Referring briefly to FIG. 3, the 5 KHz sinusoidal signal passed by filter 96 is designated generally by reference numeral 102, while the demodulated waveform provided by envelope detector 100 is designated by the pulsed signal 104. As indicated within FIG. 3, the 5 KHz signal includes a code bit pattern having 13 serially-transmitted binary bits. During those code bit intervals wherein a binary "0" is represented, the 5 KHz sinusoidal signal is not transmitted. On the other hand, during those code bit intervals during which a binary "1" is represented, the 5 KHz sinusoidal signal is transmitted. The output of envelope detector 100 is coupled by conductor 106 to input 108 of code multiplexer 88.

After the 30 millisecond receiver recovery period has elapsed, address counter 78 is incremented periodically at 500 microsecond intervals. Address counter 78 includes a clock (C) input terminal coupled by conductor 110 to one of the phase clock signals generated by clock generator 74. Address counter provides a plurality of output terminals, designated within FIG. 2 by $Q_p$, coupled by conductors 112 to a corresponding plurality of address input terminals of read-only memory 80. Read-only memory 80 includes a clock (C) input terminal coupled by conductor 114 to one of the phase clock signals generated by clock generator 74. Upon receiving the corresponding phase clock pulse, the address received from conductors 112 is noted by memory 80, and data stored within the address location is accessed. A first portion of the accessed data is used to provide a programmed instruction to processor 82 via a plurality of conductors designated generally by reference numeral 116. A second portion of the accessed data is used to provide multiplexer control signals which are coupled by conductors designated generally by reference numeral 118 to code multiplexer 88. In addition, one bit of the accessed data may be used to provide a stored code bit coupled by conductor 120 to a second input terminal 122 of code multiplexer 88.

Processor 82 includes a clock (C) input coupled by conductor 124 to yet another of the phase clocks provided by clock generator 74. During the appropriate clock phase, processor 82 notes the instruction provided to it by conductors 116 and performs a corresponding operation. Within one 10 millisecond code bit interval, processor 82 receives 20 clock pulses, and hence, receives 20 instructions from memory 80. While the specific operations performed by processor 82 are described in further detail below, the primary function of processor 82 is to compare the code bit received by 5 KHz filter 96 during each of the 13 code bit intervals with a corresponding code bit pattern stored within memory 80.

Processor 82 is coupled to a bi-directional data bus 126 for both receiving and transmitting one bit of data. Data bus 126 is coupled by conductor 128 to the output 130 of code multiplexer 88 for receiving either stored code bit information from memory 80 or the bit received by filter 96 during each code bit interval. Processor 82 may then compare the received code bit with the stored code bit and determine whether or not thev are the same. Provided that the proper code bit has been received for a given code bit interval, processor 82 causes a high level or logic "1" to be output on data bus 126 and simultaneously causes a WRITE signal to be generated; the WRITE signal is coupled by conductor 132 to a clock (C) input of data latch 86 for causing the same to latch the data provided to the data input terminal (D) thereof by data bus 126. The Q output of data latch 86 assumes a high level or logic "1" provided that the proper code bit has been detected during the particular code bit interval and otherwise latches a low level or "logic 0". The Q output of data latch 86 is coupled by conductor 134 to the data input terminal (D) of power-on latch 40. As shown within FIG. 2, the Q output of data latch 86 may also be coupled by conductor 136 to a third input terminal 138 of code multiplexer 88 for reasons described more fully below.

Processor 82 further includes a RTN output terminal coupled by conductor 140 to a clock (C) input of power-on latch 40. After writing the appropriate data into data latch 86 during each code bit interval, processor 82 receives an instruction from memory 80 which causes processor 82 to provide an output pulse via conductor 140 to the clock input of power-on latch 40. Assuming that the proper code bit was detected during a given code bit interval, then data latch 86 would latch a logic "1", and power-on latch 40 would subsequently also latch a logic "1". In this event the $\overline{Q}$ output of power-on latch 40 would remain at a low level, allowing power switch 42 to remain conductive. On the other hand, if, during a particular code bit interval, an improper code bit were received by 5 KHz filter 96, then data latch 86 would store a logic "0" which would subsequently be latched by power-on latch 40. Immediately thereafter, the $\overline{Q}$ output of power-on latch 40 would switch to a high level, causing power switch 42 to assume a non-conductive state. In this event, power supply terminal 52 would be electrically decoupled from 6 volt battery 36. As a result, all of the code processing channel components shown within FIG. 2 would be turned off to minimize power drain upon battery 36 and would remain off until filter 34 again detects the 2.083 KHz signal.

If, following receipt by filter 34 of the 2 KHz signal, processor 82 determines that the 13 code bits received by 5.0 KHz filter 96 during the 13 successive code bit intervals properly correspond to the code bit pattern stored within memory 80, then a predetermined instruction is provided by memory 80 to processor 82 during the 13th code bit interval. Upon receipt of this instruction, processor 82 generates an output pulse coupled by conductor by 142 to the clock (C) input of correct code latch 84. It will be recalled that correct code latch 84 is reset each time that power is initially switched on to the code processing channel components. Upon receiving the clock pulse via conductor 142, the Q output of correct code latch 84 switches from a low level or logic "0" to a high level or logic "1". The Q output of correct code latch 84 is coupled by conductor 144 to a SET (S) input of data latch 86; when the Q output of correct code latch 84 switches to a high level for indicating that all 13 code bits have been properly received, the Q output of data latch 86 is forced to a high level or logic "1" irrespective of the binary data thereafter presented to the DATA (D) input thereof. Accordingly, conductor 134 thereafter couples a logic "1" to the DATA (D) input of power-on latch 40 for continuously maintaining power switch 42 in a conductive state.

Still referring to FIG. 2, address counter 78 includes a most significant bit output terminal $Q_M$ which provides an output signal having a frequency equal to that of the clock signal received at the clock (C) input of address counter 78 divided by 4,096. Thus, since the frequency of the clock signal received by address counter 78 is 2 KHz, the signal provided by the $Q_M$ is approximately one-half cycle per second. As shown in FIG. 2, the $Q_M$ output terminal of address counter 78 is coupled by conductor 146 to the clock (C) input of address counter extension 78'. Like address counter 78, counter 78' includes a reset terminal coupled to reset conductor 90. Counter 78' includes a Q output terminal, and counter 78' is configured so as to switch the Q output thereof from a low level to a high level upon receiving three positive-going clock signal transitions at the clock terminal thereof. Since the signal provided by the $Q_M$ output of address counter 78 is initially at a low level and has a frequency of approximately one-half cycle per second, counter 78' requires approximately 5 seconds after any reset operation before it can switch its Q output to a high level. The Q output of counter 78' is coupled by conductor 148 to firing circuit 150. Upon detecting the transition of the Q output of counter 78' from a low to a high level, firing circuit 150 creates an alarm, as by firing a squib for explosively dispensing tear gas dust, rare earth oxide tracer, smoke and dye.

It will be recalled that one of the objects of the present invention is to incorporate a hold-off feature wherein firing circuit 150 is not triggered so long as the article housing the receiver circuitry shown within FIG. 2 is within the presence of the radio field transmitted near the exit from the protected premises. This hold-off feature is provided by the circuitry shown within FIG. 2 in the following manner. Until the article housing the receiver circuitry is removed from the transmitted radio field, 2.083 KHz filter 34 will continue to receive periodic transmissions of the 2.083 KHz signal every 160 milliseconds as shown in FIG. 3. Accordingly, 2.083 KHz filter 34 will continue to apply an input pulse to OR gate 92 every 160 milliseconds; in turn, reset conductor 90 will apply a reset pulse to address counter 78 and address counter extension 78' every 160 milliseconds. Within a 160 millisecond interval, address counter 78 may be incremented by the 2 KHz clock signal received thereby only 320 times before again being reset. Thus, the most significant bit of address counter 78 does not change state, and hence, no clock pulses are provided to counter 78'. Alternatively, once the article housing the receiver circuitry is removed from the vicinity of the exit such that the 2.083 KHz signal is no longer received, no further reset pulses are applied to either address counter 78 or address counter extension 78'; approximately five seconds after the article housing the receiver circuitry is removed from the field transmitted near the exit, firing circuit 150 is triggered. This hold-off feature prevents the firing circuit from being triggered in the event that the thief lingers near the exit from the protected premises before making his escape.

With brief reference to FIG. 3, the wave forms corresponding to the 2.083 KHz signal and the 5 KHz coded signal shown therein have been noted above. The lower most wave form within FIG. 3 represents the composite wave form transmitted by the transmitter in the vicinity of each exit from the protected premises. The composite wave form includes both the 2.083 KHz signal as well as the 5 KHz coded signal.

Figure 5A:
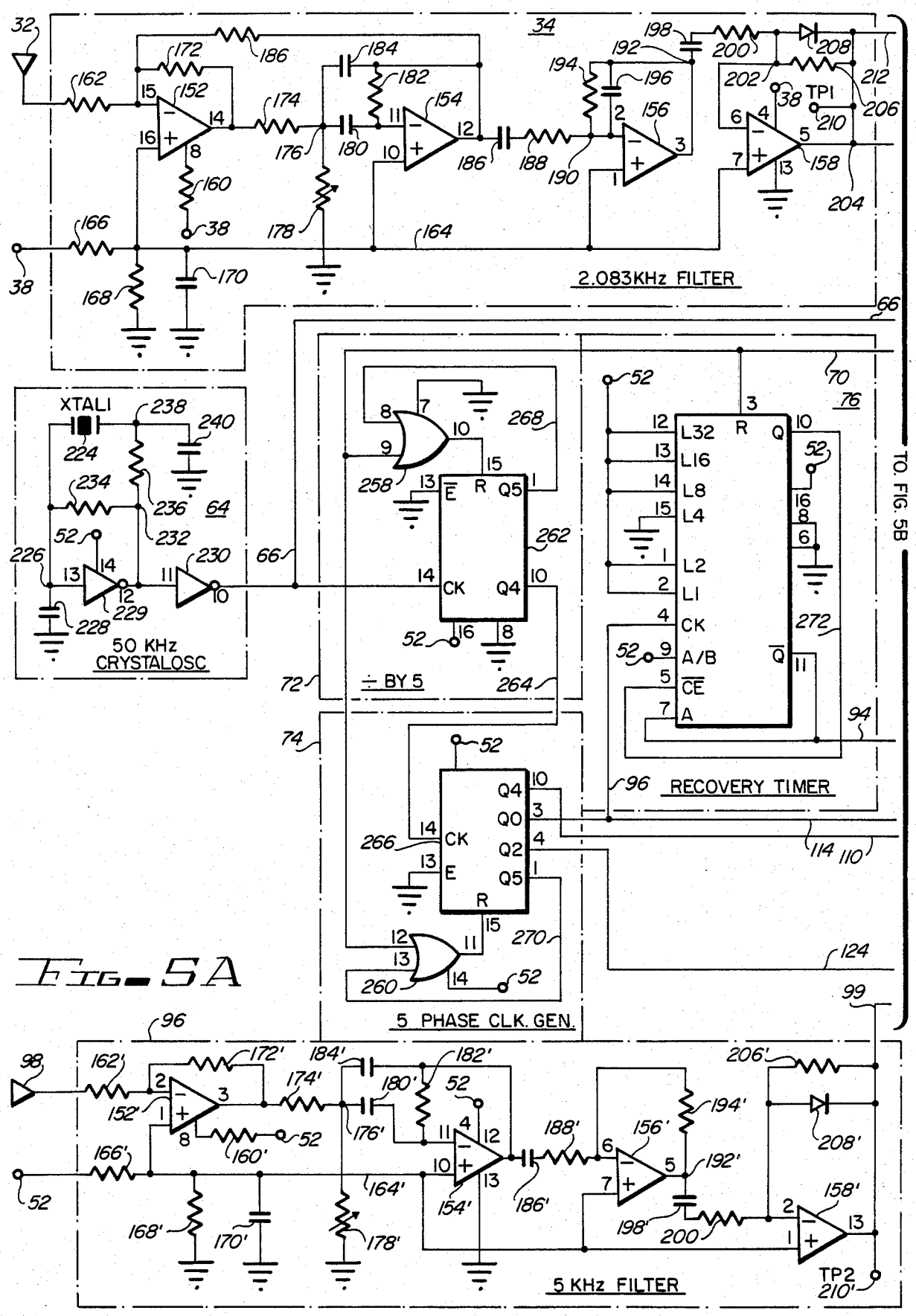
FIGS. 5A–5C together form a circuit schematic of the receiver circuity shown in block form within FIG. 2.
Figure 5B:
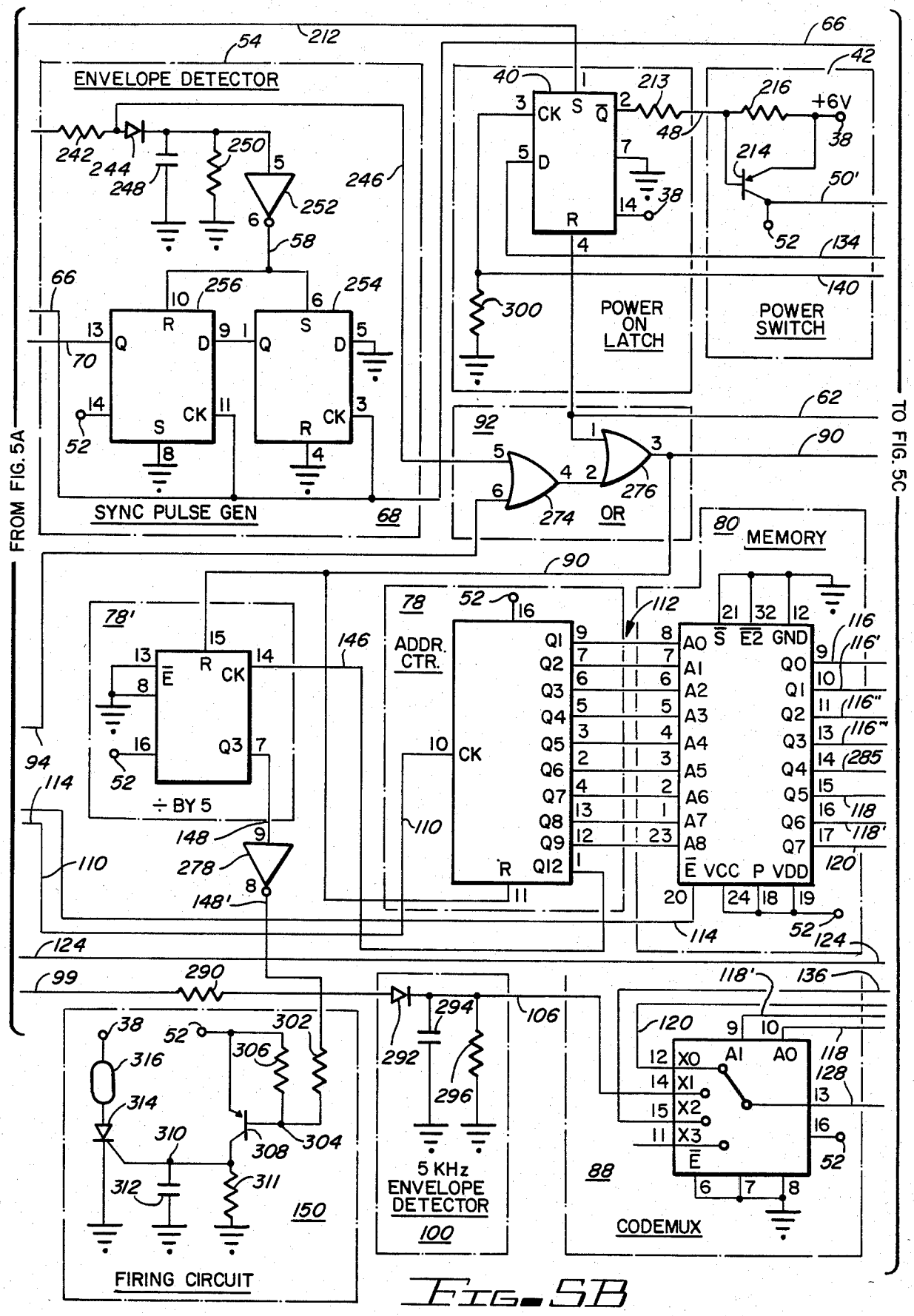
Figure 5C:
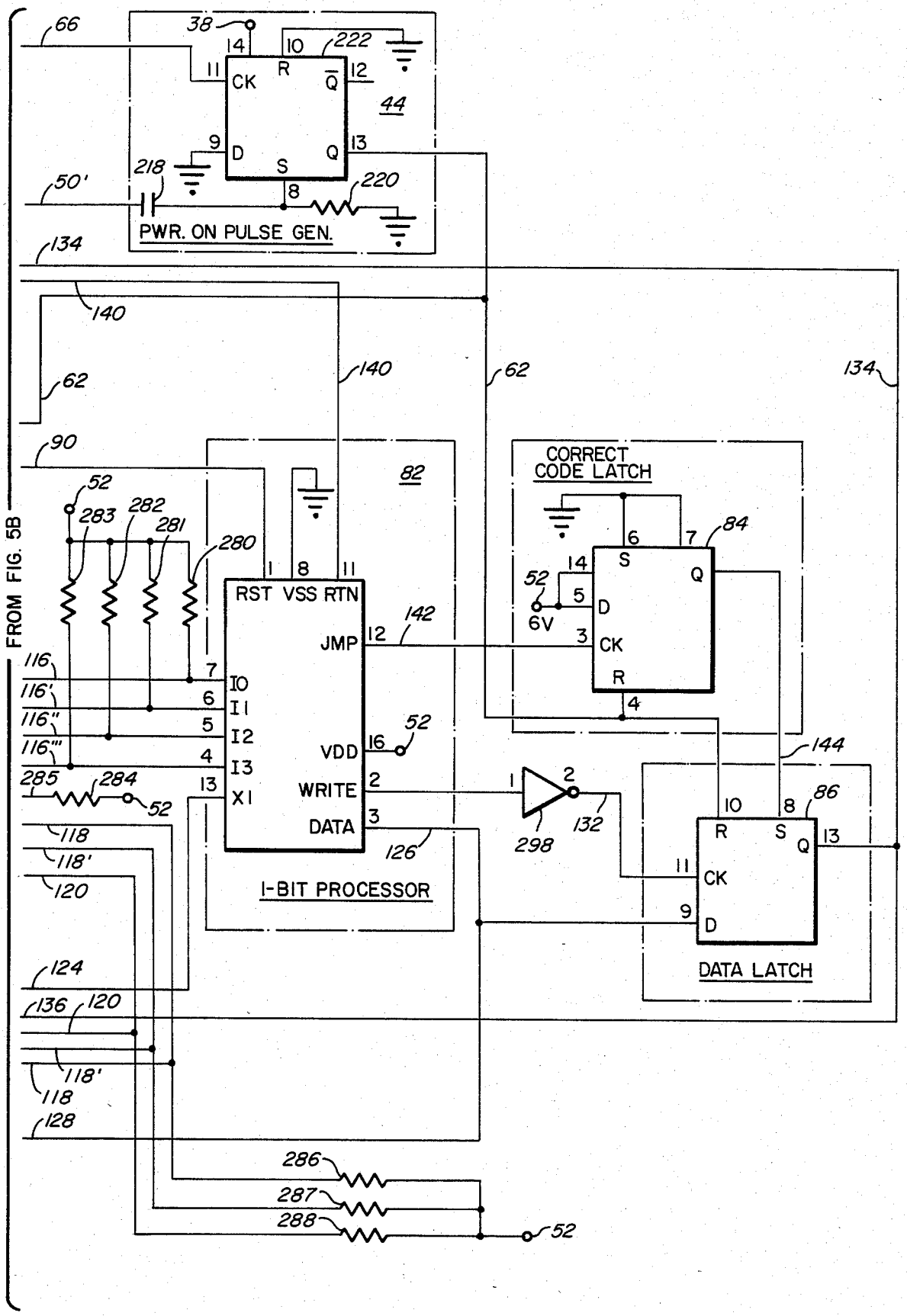

FIGS. 5A–5C form a detailed circuit schematic illustrating the implementation of the receiver circuit shown in block diagram form within FIG. 2. Those portions of circuitry shown within FIGS. 5A–5C which correspond to elements previously identified within FIG. 2 have been designated by like reference numerals. As shown within FIG. 5A, 2.083 KHz filter 34 includes 4 operational amplifiers 152, 154, 156 and 158. In the preferred embodiment of the present invention, operational amplifiers 152, 154, 156 and 158 are provided by a single integrated circuit commercially available from EXAR Integrated Systems, Inc., of Sunnyvale, Calif. as a model number XR-4202 programmable quad operational amplifier. The pin numbers indicated adjacent the various input and output terminals of these operational amplifiers correspond to the pin numbers for the model number XR-4202.

With reference to operational amplifier 152, resistor 160 extends from pin 8 of the XR-4202 integrated circuit to power supply terminal 38. Within FIGS. 5A–5C, power supply terminal 38 is intended to correspond to power supply conductor 38, shown within FIG. 2 as being directly coupled to a 6 volt battery 36. The operating current within each of the 4 operational amplifiers 152, 154, 156 and 158 may be varied or programmed by varying the magnitude of biasing resistor 160. As the value of resistor 160 is increased, the bandwidth of operational amplifiers 152–158 decreases. Within the preferred embodiment of the present invention, resistor 160 has a value of 10.0 Megohms in order to minimize power drain upon battery 36 while simultaneously causing op amps 152–158 to exhibit a very narrow bandwidth. Through proper selection of the various resistive and capacitive components associated with op amps 152–158, operational amplifiers 152–158 provide a highly sensitive and highly selective circuit for filtering and amplifying a 2.083 KHz signal, while at the same time minimizing power drain upon battery 36.

Still referring to FIG. 5A, antenna 32 is coupled through resistor 162 to pin 15 of the XR-4202 integrated circuit, corresponding to the inverting input terminal of operational amplifier 152. The non-inverting input terminal of amplifier 152 (pin 16) is coupled to a bias conductor 164. Bias conductor 164 is also coupled to the non-inverting input terminal (pin 10) of amplifier 154, and to the non-inverting input terminal (pin 1) of amplifier 156, and to the non-inverting input terminal (pin 7) of amplifier 158. The bias voltage applied to bias conductor 164 is provided by a resistive divider network including resistors 166 and 168 coupled between power supply terminal 38 and ground. Filter capacitor 170 extends between bias conductor 164 and ground.

The output terminal (pin 14) of amplifier 152 is coupled by feedback resistor 172 to the inverting input terminal thereof. The output terminal of amplifier 152 is also coupled by resistor 174 to node 176. A trimmable resistor 178 extends from node 176 to ground and is trimmed during final testing to adjust the center frequency of filter 34.

The output signal provided to node 176 by amplifier 152 is coupled to the inverting input terminal (pin 11) of amplifier 14 by capacitor 180. The output terminal (pin 12) of amplifier 154 is coupled by feedback resistor 182 to the inverting input terminal thereof and by feedback capacitor 184 to node 176. The output terminal of amplifier 154 is further fed back by resistor 186 to the inverting input terminal of amplifier 152.

Amplifiers 152 and 154 form the frequency selective portion of the 2.083 KHz filter 34, while amplifiers 156 and 158 provide gain for the signals passed by amplifiers 152 and 154. Amplifiers 152 and 154 make use of a Q-multiplier phenomenon applied to a second-order bandpass filter transfer function T(s). Transfer function T(s) may be represented as follows:

$$T(s) = \frac{\frac{\omega}{Q} s}{S^2 + \frac{\omega}{Q} s + \omega^2}$$

The equation above represents the transfer function performed by amplifier 154. If $\beta$ represents the positive feedback attenuation factor (i.e., the ratio of resistor 172 to resistor 186,) then the transfer function effected by the combination of amplifiers 152 and 154 is the following:

$$T(s)\ \text{comb} = \frac{\frac{\omega}{Q} s}{s^2 + \frac{\omega}{\left(\frac{Q}{1-\beta}\right)} s + \omega^2}$$

As $\beta$ (i.e., the ratio R172/R186) approaches unity, the overall filter selectivity becomes infinitely narrow, i.e., the overall Q value becomes very large. This may be seen more clearly by expressing the overall Q value for amplifiers 152 and 154 in terms of the Q value for amplifier 154 alone, as follows:

$$Q_{comb} = \frac{QT(s)}{1-\beta}$$

Within the preferred embodiment of the present invention, the values for resistor 172 and resistor 186 are 3 Megohms, and 3.3 Megohms respectively. Substitution of these values into the above equation results in the following:

$$Q_{comb} = \frac{QT(s)}{1-.909} = \frac{QT(s)}{.091} = 10.00\ QT(s)$$

Thus, it should be understood that the overall Q-value for the combination of amplifiers 152 and 154 is approximately 11 times the Q value provided by amplifier 154 alone.

The feedback configuration shown for amplifiers 152 and 154 would ordinarily be subject to unstable oscillation were ordinary operational amplifiers utilized. Indeed, the present inventor experimented with seven different types of operational amplifiers in order to satisfy the low power, selectivity, and sensitivity requirements of the 2.083 KHz filter 34. When other types of operational amplifiers were inserted in place of the XR-4202 quad programmable unit, such other operational amplifiers either became unstable and subject to oscillation, provided unsatisfactory gain, could not be adjusted to a center frequency of 2.083 KHz, and/or could not achieve the foregoing without drawing in excess of 30 microamperes of current.

The output of operational amplifier 154 is coupled by capacitor 186 and resistor 188 to node 190 and to the inverting input terminal (pin 2) of operational amplifier 156. The output (pin 3) of amplifier 156 is coupled to node 192 and is fed back to input node 190 by resistor 194 and capacitor 196 coupled in parallel with one another. The output signal provided to node 192 by amplifier 156 is coupled by series-connected capacitor 198 and resistor 200 to node 202 and to the inverting input terminal (pin 6) of amplifier 158. As shown within FIG. 5A, pin 13 of the integrated circuit containing amplifiers 152, 154, 156 and 158 is coupled to ground potential, while pin 4 thereof is coupled to power supply conductor 38. The output terminal (pin 5) of amplifier 158 is coupled to node 204, and node 204 is coupled by feedback resistor 206 to input node 202. A clamping diode 208 is coupled across feedback resistor 206 with its anode coupled to node 202 and its cathode coupled to node 204. A test point terminal 210 may be provided to facilitate the insertion of a probe during testing of 2.083 KHz filter 34. Overall, amplifiers 156 and 158 provide approximately 40 decibels of gain for the 2.083 KHz signal selected by filter stage amplifiers 152 and 154.

As shown within the lower portion within FIG. 5A, 5 KHz filter 96 is substantially similar to 2.083 KHz filter 34, and corresponding components therein have been designated by primed reference numerals. One significant difference between filter 96 and filter 34 is that the connections to the +6 volt power supply are made via switched power supply terminal 52 rather than directly to battery 36.

Returning again to the 2.083 KHz filter, node 204 is coupled by conductor 212 to the SET input (pin 1) of power-on latch 40 formed by one-half of an integrated circuit type MC 14013 BCP. Latch 40 is coupled to power supply terminal 38 for continuously receiving power from the battery.

Also shown within FIG. 5B is power switch block 42. Conductor 48 is coupled by 10K ohm resistor 213 to the $\overline{Q}$ output (pin 2) of latch 40 and is coupled to the base terminal of switching PNP transistor 214. The base terminal of transistor 214 is also coupled by bias resistor 216 to power supply terminal 38. The emitter terminal of transistor 214 is coupled to power supply terminal 38 as well. The collector terminal of transistor 214 is coupled to switched power supply terminal 52 for selectively coupling the code processing channel components to the 6 volt battery. Whenever the $\overline{Q}$ output of latch 40 is at a low level, transistor 214 is biased so as to conduct current from +6 volt terminal 38 to +6 volt terminal 52.

Referring briefly to FIG. 2, it will be recalled that power switch 42 provides a SET pulse via conductor 50' to a power-on pulse generator 44. As shown in FIGS. 5B and 5C, the collector terminal of transistor 214 is coupled by conductor 50' to one end of charging capacitor 218, the opposite end of which is coupled through resistor 220 to ground. The juncture of charging capacitor 218 and resistor 220 is coupled to the SET input (pin 8) of a clocked data latch 222 within power-on pulse generator 44, which data latch is preferably integrated circuit type HEF 4013 BTD. Each time that transistor 214 within power switch 42 is rendered conductive, the voltage upon conductor 50' rises quickly toward +6 volts. The voltage at pin 8 of latch 222 also rises toward +6 volts and causes latch 222 to be set. The voltage at pin 8 of latch 222 thereafter decays back toward ground potential as capacitor 218 is charged through resistor 220. Consequently, the Q output (pin 13) switches to a low level for resetting, via conductor 62, power on latch 40, correct code latch 84, and data latch 86.

Referring again briefly to FIG. 2, it will be recalled that the code processing channel circuitry 60 includes a 50 KHz oscillator 64. As shown within FIG. 5A, crystal oscillator 64 includes a crystal 224 designed to oscillate at a frequency of 50 KHz. One terminal of crystal 224 is coupled to node 226 which, in turn, is coupled to capacitor 228 to ground potential. Node 226 is also coupled to the input terminal (pin 13) of an inverter circuit 229 corresponding to inverting Schmidt trigger integrated circuit type HEF 4106B. As indicated within FIG. 5A, pin 14 of the integrated circuit containing inverter 229 is coupled to switched power supply terminal 52. The output terminal (pin 12) of inverter 228 is coupled to the input terminal (pin 11) of a second inverter 230 and to node 232. Node 234 is coupled by feedback resistor 234 to node 226 and by resistor 236 to node 238. Node 238 is coupled to the second terminal of crystal 224 and to one end of capacitor 240, the opposite end of which is coupled to ground. Inverter 229 produces an oscillating 50 KHz output signal which is squared by inverter 230 and provided as a master clock signal at the output terminal (pin 10) thereof. The 50 KHz master clock is routed by conductor 66 to divide-by-five counter 72, to sync pulse generator 68, and to the clock input (pin 11) of latch 222 within power-on pulse generator 44.

Referring again briefly to power-on pulse generator 44, it will be appreciated that, shortly after transistor 214 of power switch 42 applies power to crystal oscillator 64, the clock input of latch 222 will receive a clock pulse. The data terminal (pin 9) of latch 222 is coupled to ground; hence, upon receipt of the first clock pulse from oscillator 64, the Q output of latch 222 will return to a low voltage level and terminate the reset pulse transmitted by conductor 62.

Referring now to FIG. 5B, envelope detector 54 includes a resistor 242 having a first end coupled to node 204 (see FIG. 5A) for receiving the amplified 2.083 KHz signal. The second end of resistor 242 is coupled to the anode of diode 244 and to a conductor 246. The cathode of diode 244 is coupled to a first end of capacitor 248 and to the first end of resistor 250. The second end of capacitor 248 and the second end of resistor 250 are each coupled to ground. Diode 244 rectifies the amplified 2.083 KHz signal while the parallel RC network formed by resistor 250 and capacitor 248 filters the rectified signal provided at the cathode of diode 244. Consequently, the voltage at the cathode of diode 244 corresponds to the envelope of the 2.083 KHz pulsed signal, designated by reference numeral 56 within FIG. 3. The cathode of diode 244 is also coupled to the input terminal of inverter 252, corresponding to pin 5 of a hex inverter integrated circuit type HEF 4106 BTD. The output terminal (pin 6) of inverter 252 is coupled to conductor 58 for providing a squared output wave form which switches to a high level when the voltage at the cathode of diode 244 exceeds the input threshold of inverter 252.

Conductor 258 is in turn coupled to the Set input (pin 6) of a first clocked flip-flop 254 and to the Reset input (pin 10) of a second clocked flip-flop 256 within sync pulse generator 68. First and second flip-flops 254 and 256 may be provided by a single integrated circuit type HEF 4013 BTD. The Reset input (pin 4) of flip-flop 254 and the Set input (pin 8) of flip-flop 256 are each coupled to ground. The Clock input (pin 3) to flip-flop 254 and the Clock input (pin 11) to flip-flop 256 are commonly coupled to 50 KHz master clock conductor 66. The Data input (pin 5) to flip-flop 254 is coupled directly to ground, while the Data (pin 9) of flip-flop 256 is coupled to the Q output terminal (pin 1) of flip-flop 254. Flip-flops 254 and 256 are powered via pin 14 coupled to switch 6 volt power supply terminal 52. The Q output terminal (pin 13) of flip-flop 256 is coupled to conductor 70 for providing a synchronized reset pulse following the detection of the 2.083 KHz envelope.

The operation of sync-pulse generator 68 will now be described with reference to FIG. 5B. Upon the detection of the envelope of the 2.083 KHz signal, conductor 58 of envelope detector 54 switches to a low level. The low level presented to the Set input of flip-flop 254 forces the Q output thereof to assume a high level. Conversely, the low level received at the Reset input of flip-flop 256 causes the Q output of flip-flop 256 to assume a low level. The Set and Reset inputs of flip-flops 254 and 256 are sensitive to the high level to low level transition, i.e., the negative edge, of the output signal provided by envelope detector 54 on conductor 58. Upon receiving the first clock pulse from master clock 64 immediately after flip-flops 254 and 256 are set and reset, respectively, flip-flop 254 clocks a low level from its Data input to its Q output. Simultaneously, flip-flop 256 clocks a high level from its Data input to its Q output. Thus, at the occurrence of the first clock pulse, the synchronizing signal distributed by conductor 70 switches from a low level to a high level. Upon the receipt of the second clock pulse from master clock 64 following the setting and resetting of flip-flops 254 and 256 respectively, flip-flop 256 clocks a low level from its data input to its Q output; accordingly, the synchronizing signal distributed by conductor 70 then switches from a high level to a low level. From the foregoing, it will be clear to those skilled in the art that sync-pulse generator circuit 68 provides a synchronizing signal distributed by conductor 70 which signal provides a positive going pulse having a pulse width equal to the period of master clock 64 (20 microseconds) generated shortly after the initial detection of each 2.083 KHz signal pulse.

Conductor 70, which conducts the synchronizing pulse generated by syhc-pulse generator 68, is coupled to the Reset input (pin 3) of recovery timer 76, to a first input (pin 9) of an OR gate 258 within divide-by-five counter 72, and to a first input (pin 12) of an OR gate 260 within 5-phase clock generator 74. OR gates 258 and 260 may each constitute one of four such OR gates provided by a single integrated circuit type HEF 4071 BTD, which integrated circuit is powered from +6 Volt switched power supply terminal 52 at pin 14 thereof. The output terminal (pin 10) of OR gate 258 is coupled to the Reset input (pin 15) of a divide-by-five Johnson-type clocked counter 262, the clock terminal (pin 14) of which is coupled to master clock signal conductor 66. Johnson counter 262 may be of the integrated circuit type HEF 4017 BTD, and is powered, via pin 16, by the +6 volt switched power supply terminal 52. The Enable input ($\overline{E}$ pin 13) of Johnson counter 262 is coupled to ground.

Johnson counter 262 includes a plurality of output terminals, including those shown in FIG. 5A as Q4 (pin 10) and Q5 (pin 1). OR gate 258 passes the positive-going sync-pulse distributed by conductor 70 to the Reset input of Johnson counter 262 for initially causing each of the output terminals thereof to assume a low level, with the exception of the Q0 output terminal (not shown) which assumes a high level. Upon receipt of the fourth master clock pulse following termination of the sync-pulse signal distributed by conductor 70, the Q4 output terminal of Johnson counter 262 is switched to a high level. The Q4 output terminal of Johnson counter 262 is coupled by conductor 264 to the Clock input terminal (pin 14) of an identical Johnson counter 266 within 5-phase generator 74. The positive-going edge of the output signal provided by the Q4 output terminal of Johnson counter 262 serves as a clock pulse to Johnson counter 266. Upon receiving the fifth master clock pulse subsequent to the termination of the sync-pulse signal distributed by conductor 70, the Q4 output terminal of Johnson counter 262 is returned to a low level, and the Q5 output terminal thereof temporarily switches to a high level. The Q5 output terminal of Johnson counter 262 is coupled by conductor 268 to a second input terminal (pin 8) of OR gate 258; OR gate 258 passes the high level of output terminal Q5 to the Reset input (pin 15) of Johnson counter 262, thereby causing output terminals Q1–Q5 of Johnson counter 262 to return to a low level, while causing output terminal Q0 to assume a high level. The aforementioned cycle of Johnson counter 262 is continuously repeated so long as the power supply is coupled thereto, whereby Johnson counter 262 causes the Q4 output terminal thereof to provide a positive-going pulse for every five master clock signals received thereby. Consequently, Johnson counter 266 is clocked at a frequency of 10 KHz, or every 100 microseconds.

With regard to Johnson counter 266, the sync-pulse distributed by conductor 70 is passed by OR gate 260 to the Reset input (pin 15) of Johnson counter 266 to force the various terminals thereof to each provide a low level. Like counter 262, counter 266 is powered from the +6 Volt switched power supply terminal 52, and its Enable input ($\overline{E}$ pin 13) is connected to ground. Upon being reset by the sync pulse, output terminals Q2 (pin 4), Q4 (pin 10), and Q5 (pin 1) are each forced to a low level, while output Q0 (pin 3) assumes a high level. As shown in FIG. 4, each time Johnson counter 266 receives a clock pulse from the 10 KHz signal provided by output Q4 of Johnson counter 262, the high level initially provided by the output Q0 of Johnson counter 266 is shifted to the next successive output terminal. As further shown in FIG. 4, receipt of a further clock pulse after output Q4 has assumed a high level returns the Q4 output to a low level and forces the Q0 output of Johnson counter 266 to a high level whereby the aforementioned cycle is repeated.

Referring again to FIG. 5A, receipt of a further clock pulse by Johnson counter 266 after the output Q4 is at a high level causes output Q5 to temporarily assume a high level. Conductor 270 couples the Q5 output terminal to a second input (pin 13) of OR gate 260 which passes the high level provided by the Q5 output terminal to the Reset input (pin 15) of Johnson counter 266. As mentioned above, a reset pulse applied to Johnson counter 266 causes output terminals Q1–Q5 to assume a low level, while forcing the Q0 output terminal to assume a high level.

As shown in FIG. 4, the Q0, Q2 and Q4 output terminals of Johnson counter 266 provide signals which may serve as clock phases for each 500 microsecond time period. The Q0 phase clock signal is coupled by conductor 96 to the clock input (pin 4) of recovery timer 76. The Q0 phase clock signal is further coupled by conductor 114 to the Enable input ($\overline{E}$ pin 20) of Memory 80 (see FIG. 5B). Phase clock signal Q2 is coupled by conductor 124 to the clocking input X1 (pin 13) of processor 82 (see FIG. 5C). In addition, the Q4 clock phase signal is coupled by conductor 110 to the clock input (pin 10) of address counter 78 (see FIG. 5B).

It will be recalled that recovery timer 76 discussed above with regard to FIG. 2 is used to effect a 30 millisecond recovery period following each receipt of the 2.083 KHz pulsed signal for allowing the code processing channel components to become initialized before processing the transmitted code bits. In the preferred embodiment of the present invention, recovery timer 76 is formed by an integrated circuit type HEF4557BTD variable width, shift register powered from the +6 Volt switched power supply terminal 52. The L1–L32 input control terminals (pins 1, 2 and 12–15) thereof program the shift register to have an effective length of 60 bits (bit length equals 1 plus the binary control input provided to L1–L32).

The shift register of recovery timer 76 is initially reset by the sync pulse distributed by conductor 70. Consequently, the Q output (pin 10) of recovery timer 76 is initially at a low level, while the $\overline{Q}$ output terminal (pin 11) thereof assumes a high level. The Q output of recovery timer 76 is coupled by conductor 272 to the Clock Enable ($\overline{CE}$ pin 5), whereby the low level provided by the Q output terminal enables the Clock input (pin 4) of recovery timer 76. The $\overline{Q}$ output serves as the data input to the A-input terminal (pin 7) of recovery timer 76.

After initially being reset by the sync-pulse, each successive Q0 clock phase signal received via conductor 96 inputs a logic "1" from the Q output (pin 11) into the A-input terminal (pin 7) and causes a shift of one bit position within the aforementioned shift register. Upon receiving the 60th Q0 clock phase signal following the initial receipt of the sync pulse, the Q output of recovery timer 76 is switched to a high level (logic "1"), and conversely, the $\overline{Q}$ output thereof switches to a low level (logic "0"). Conductor 272 couples the high level provided by the Q output to the Clock Enable input of recovery timer 76, thereby preventing the Clock input of recovery timer 76 from responding to further Q0 clock phase signals.

The $\overline{Q}$ output of recovery timer 76 is coupled by conductor 94 to a first input (pin 6) of OR gate 274 within OR gate block 92. The second input (pin 5) of OR gate 274 is coupled to conductor 246 for receiving a signal derived from the output of the 2.083 KHz filter 34 (see FIG. 5A). The output of inverter 274 (pin 4) is coupled to a first input (pin 2) of OR gate 276. A second input (pin 1) of OR gate 276 is coupled to conductor 262 for receiving the reset pulse generated by power-on pulse generator 44. OR gates 274 and 276 forming OR block 92 are preferably provided by a single integrated circuit type HEF4071BTD. The output terminal (pin 3) of OR gate 276 provides a Reset signal via conductor 90 to the Reset input (pin 1) of one bit processor 82, to the Reset input (pin 11) of address counter 78, and to the Reset input (pin 15) of address counter extension 78'. Thus, following the detection of the 2.083 KHz signal, the output signal provided by recovery timer 76 via conductor 94 holds one bit processor 82, address counter 78, and address counter extension 78' in a reset condition during the entire 30 millisecond receiver recovery period (see FIG. 3).

Address counter 78 shown in FIG. 5B is preferably formed by an integrated circuit type HEF4040BTD and is powered from +6 Volt switched power supply terminal 52. As shown in FIG. 5B, address counter 78 includes a plurality of output terminals Q1 (pin 9) through Q9 (pin 12) for representing the nine lower order bits of the binary count stored within address counter 78. The Q1 output terminal is the lowest order bit of the count and changes state upon receipt of each Q4 clock phase signal at the Clock input terminal of address counter 78. The nine lower order output terminals of address counter 78 are coupled to the correspondingly-weighted address input terminals of memory 80, which is preferably formed by an integrated circuit type IM6654 erasable programmable read-only-memory (EPROM) powered from +6 Volt switched power supply terminal 52. Thus, the least significant Q1 output terminal of address counter 78 is coupled to the least significant address input A0 (pin 8) of memory 80, while the Q9 output of address counter 78 is coupled to the A8 (pin 23) input of memory 80.

Still referring to FIG. 5B, address counter 78 includes a twelfth-order (or most significant) output terminal Q12 (pin 1) coupled by conductor 146 to the Clock input terminal (pin 14) of address counter extension 78'. Address counter extension 78' is preferably formed by an integrated circuit type HEF4017BTD Johnson counter powered from the +6 Volt switched power supply terminal 52. The Q3 (pin 7) output terminal of address counter 78' is coupled by conductor 148 to the input terminal of an inverter gate 278, the output terminal of which is coupled by conductor 148' to firing circuit 150, the details of which are described below. Inverter 287 may be one of the six inverters provided within previously mentioned integrated circuit type HEF4106BTD.

Referring again to memory 80 within FIG. 5B, the address presented to the address input terminals A0–A8 is noted each time a Q0 clock phase signal is received by the Enable input (pin 20) of memory 80, and the enabled address is then used to access an eight-bit data word stored therein at the corresponding address. Memory 80 includes a plurality of output terminals Q0 (pin 9) through Q7 (pin 17) for providing the accessed data word. The Q0, Q1, Q2, and Q3 output terminals of memory 80 are coupled by conductors 116', 116" and 116"' to the I0 (pin 7), I1 (pin 6), I2 (pin 5) and I3 (pin 4) instruction input terminals of one-bit processor 82. Conductors 116, 116', 116" and 116"' are coupled by pull-up resistors 280, 281, 282 and 283, respectively, to a +6 Volt switched power supply terminal 52.

In the preferred embodiment of the present invention, one-bit processor 82 is formed by an integrated circuit MC14500BCP. Upon each receipt of a Q2 clock phase signal at its X2 input (pin 13), processor 82 notes the 4-bit instruction code presented to instruction input terminals I0–I3 and performs a particular operation corresponding to the selected instruction input code. Thus, address counter 78 sequentially accesses 4-bit instruction codes within memory 80, which instruction codes are provided to processor 82 for performing an operation during each 500 microsecond processor timing cycle, as depicted in FIG. 4. Processor 82 is powered from the +6 Volt switched power supply terminal 52.

As shown in FIG. 5B, the Q4 output of memory 80 is a spare output and is coupled by conductor 285 to a first end of pull up resistor 284, the opposite end of which is coupled to +6 Volt switched power supply terminal 52. Output terminals Q5 and Q6 are coupled by conductors 118 and 118' to the A0 (pin 10) and A1 (pin 9), respectively, of code multiplexer 88. Conductors 118 and 118' are also coupled by pull-up resistors 286 and 287, respectivelv, to a +6 Volt switched power supply terminal 52. Code multiplexer 88 is formed by an integrated circuit type HEF 4052 and is powered from +6 Volt switched supply terminal 52. The signals received at the A0 and A1 address inputs of code multiplexer 88 serve to select one of four possible input sources to an output terminal of code multiplexer 88. One such input source is provided by the Q7 output terminal of memory 80 which is coupled by conductor 120 to the X0 (pin 12) input terminal of code mux 88. Conductor 120 is also coupled by pull-up resistor 288 to the +6 Volt switched power supply terminal 52.

A second possible input source to code mux 88 is the demodulated output of the code bit received during the corresponding code bit interval via 5 KHz filter 96 (see FIG. 5A). The output of 5 KHz filter 96 is coupled by conductor 99 to a first end of a 10K ohm resistor 290, the second end of which is coupled to the anode of a diode 292 within 5 KHz envelope detector 100. The cathode terminal of diode 292 is coupled to a first end of 2200 picofarad capacitor 294 and to a first end of 1 Megohm resistor 296, the second ends of which are each coupled to ground. Diode 292, capcitor 294 and resistor 296 demodulate the 5 KHz signal received during each code bit interval to provide a high level or low level output as determined by whether a logic "1" or logic "0" code bit, respectively, is being transmitted during each code bit interval. The demodulated output signal provided by envelope detector 100 is coupled by conductor 106 to a second input terminal X1 (pin 14) of code mux 88.

A third possible source of input to code mux 88 is derived from the output of data latch 86 (see FIG. 5C). Data latch 86 and correct code latch 84 may be provided by a single integrated circuit type HEF4013BTD clocked data latch which is powered via pin 14 from the +6 Volt switched power supply terminal 52. The Q output (pin 13) of data latch 86 is coupled by conductor 136 to the X2 input (pin 15) of code mux 88 for providing the latched output signal stored by data latch 86. A fourth data input terminal, X3 (pin 11), to code mux 88 is not utilized in the present design and is left open.

Code mux 88 includes an output terminal (pin 13) which is coupled by conductor 128 to a bi-directional data conductor 126. The output terminal of code mux 88 provides: the signal received at input X0 when the A1 and A0 input terminals each receive a low level; the input signal received at the X1 input when the A1 and A0 input terminals receive a low level and a high level, respectively; and the input signal received at the X2 input terminal when the A1 and A0 input terminals receive a high level and a low level, respectively. Bi-directional data conductor 126 is coupled to the Data port (pin 3) of processor 82 and to the Data input (pin 9) of data latch 86. Thus, the data selected by code mux 88 may be received by processor 82 and may be stored within data latch 86.

With reference to FIG. 5C, processor 82 includes a Write output (pin 2) coupled to the input terminal (pin 1) of an inverter 298. Inverter 298 may be one of six such inverters provided by the aforementioned integrated circuit type HEF4106BTD. The output terminal (pin 2) of inverter 298 is coupled by conductor 132 to the Clock input (pin 11) of data latch 86.

Processor 82 shown in FIG. 5C also includes a JMP output terminal (pin 12) coupled by conductor 142 to the Clock input terminal (pin 3) of correct code latch 84. The Data input terminal (pin 5) of correct code latch 84 is coupled to the +6 Volt switched power supply terminal 52, as is the positive voltage supply terminal (pin 14) thereof. The Reset input (pin 4) of correct code latch 84 is coupled to reset conductor 62 for being reset during each receiver recovery period (see FIG. 3), while the Set input (pin 6) of correct code latch 84 is disabled by being coupled to ground. Upon receipt of a clock pulse from the JMP output of processor 82, correct code latch 84 clocks in the high level (logic "1") presented to the Data input thereof, causing the Q output (pin 1) thereof to switch from a low level to a high level.

The Q output of correct code latch 84 is coupled by conductor 144 to the Set input (pin 8) of data latch 86, while the Reset input (pin 10) of data latch 86 is coupled to the reset conductor 62. As mentioned above, data latch 86 provides a signal to power on latch 40 (see FIG. 5B) during each code bit interval to indicate whether power switch 42 should continue to supply +6 volts to switched power supply terminal 52. Accordingly, the Q output of data latch 86 is coupled by conductor 134 to the Data input terminal (pin 5) of power on latch 40. Processor 82 includes an RTN output terminal (pin 11) which provides a clock pulse via conductor 140 to the Clock input (pin 3) of power on latch 40. A pull-down resistor 300 is also coupled between conductor 140 and ground.

It will be recalled that a firing circuit 150 is actuated upon detection of the proper code bit pattern by the receiver unit. The circuit details of the firing circuit 150 are shown in FIG. 5B. Conductor 148' is coupled from the output of inverter 278 to a first end of resistor 302, the second end of which is coupled to node 304. A biasing resistor 306 is coupled from node 304 to +6 Volt switched power supply terminal 52. Node 304 is also coupled to the base terminal of PNP transistor 308, the emitter terminal of which is also coupled to switched power supply terminal 52. The collector terminal of transistor 308 is coupled to node 310. A resistor 311 and capacitor 312 are coupled in parallel with one another between node 310 and ground. Node 310 is also coupled to the trigger input of silicon controlled rectifier 314, the cathode terminal of which is coupled to ground. An electrically actuated explosive squib 316 is coupled from the anode of silicon controlled rectifier 314 directly to +6 volt power supply conductor 38 to avoid any voltage losses across switching transistor 214 within power switch 42.

Upon detecting the proper code bit pattern within the 5 KHz signal, the receiver circuitry causes the Q3 output of address counter extension 78' to assume a high level approximately five seconds after the receiver ceases to receive the pulsed 2.083 KHz signal. Inverter 278 then applies a voltage substantially equal to ground upon conductor 148', allowing transistor 308 to be biased heavily into conduction. The current conducted by the collector terminal of transistor 308 charges capacitor 312 and allows the voltage at node 310 to rise toward +6 volts. Silicon controlled rectifier 314 is then triggered into conduction for conducting current through squib 316 and thereby deploying the tear gas, dye, smoke and/or other chemical contents of the dye pack.

Figure 9:
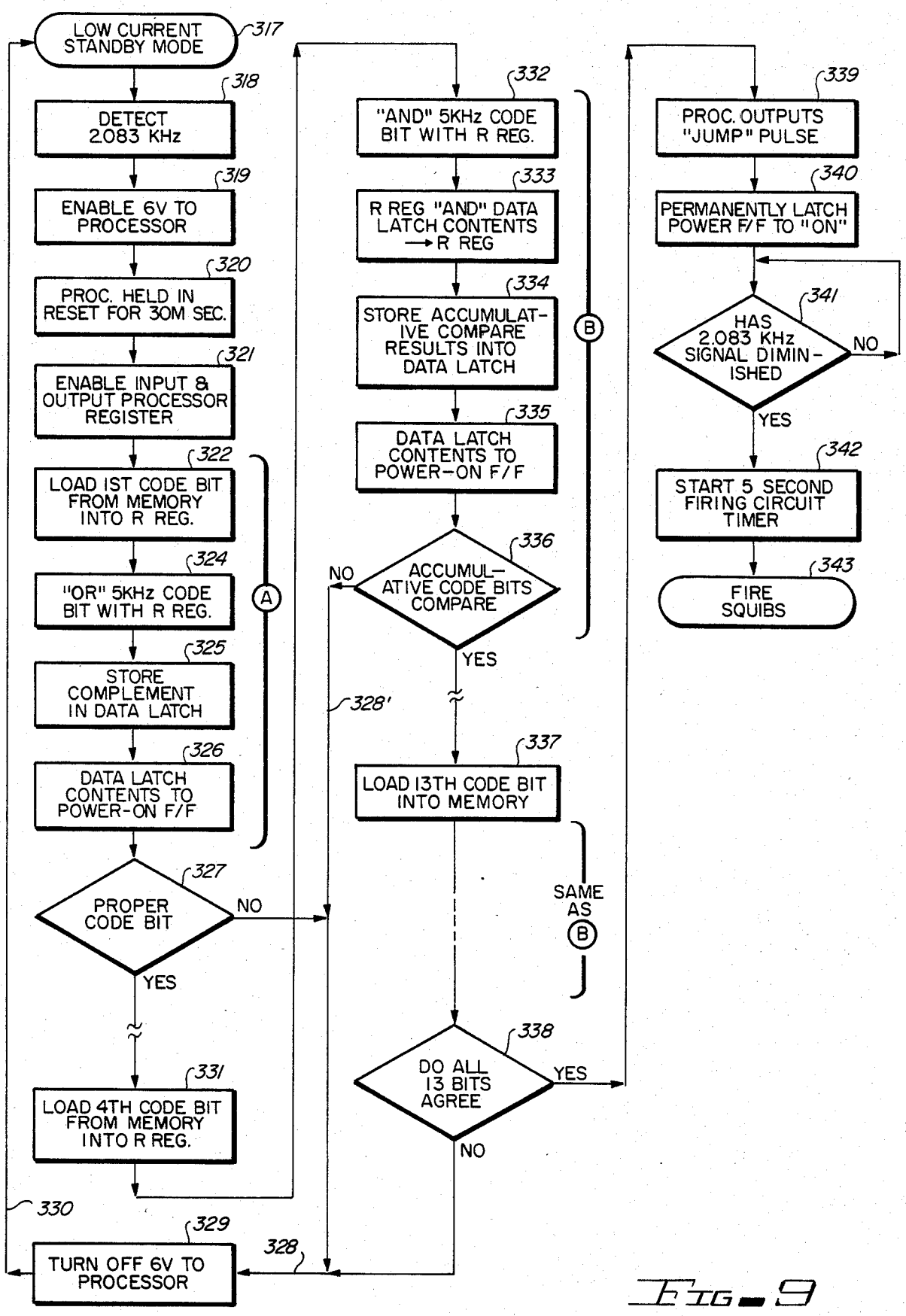
FIG. 9 is a flow chart diagram depicting the logical steps performed by the micro-processor within the receiver circuitry for comparing serially received code bits with stored code bits and for arming the alarm portion of the receiver circuit in the event that all of the code bits have been properly received.

The manner in which the processor circuitry of the receiver circuit shown in FIGS. 5A–5C determines whether the proper code bit pattern within the 5 KHz signal will now be explained with reference to the flow chart shown in FIG. 9 and the processor instruction code sheets attached as an Appendix to this Specification. With reference to FIG. 9, starting point 317 designates the low current standby mode of the receiver circuit which exists when the 2.083 KHz signal is not being detected. Upon detecting the 2.083 KHz signal, designated by block 318 within FIG. 9, +6 volts is enabled to the processor circuit components in the manner described above, as designated by block 319 within FIG. 9. Initially the processor is held in reset condition for thirty milliseconds by recovery timer 76, as designated by block 320. Beginning with the first code bit interval (see FIG. 3), the input and output processor registers within one-bit processor 82 are enabled, as designated by block 321 within FIG. 9. As shown in the first sheet of the Appendix, the first four processor instruction cycles are used to enable the input registers (address locations 00–03), while the next three processor instruction cycles are used to enable the output registers (address locations 04–06).

The next step within the first code bit interval is to load the first code bit of the stored code bit pattern from memory into the R register of one-bit processor 82, as designated by block 322. With reference to the first sheet of the Appendix, the processor instruction (LDP) which performs this function is stored at memory address location 07. This instruction causes code multiplexer 88 to select the Q7 output of memory 80 to the Data input of one-bit processor 82 for storing the same within the R register thereof. In the example shown in FIG. 3, it is presumed that the first code bit is a logic "0", and accordingly, the Q7 output from memory 80 is a logic "0" during the processor instruction cycle corresponding to memory address location 07.

The next step performed by one-bit processor 82 during the first code bit interval is to compare the code bit received from the 5 KHz signal filter during the first code bit interval to the logic "0" stored within memory 80 for the first code bit interval. This comparison is performed by selecting the received code bit via multiplexer 88 to the Data port of one-bit processor 82 and performing a logical OR operation between the code bit presented to the Data port and the stored code bit previously loaded into the R register. This logical OR operation is designated by block 324 within FIG. 9. With reference to the first sheet of the Appendix, this logical OR operation is effected by the processor instruction stored at memory address location 08; the following processor instruction stored at memory address location 09 performs no operation and merely provides a delay of 0.5 milliseconds. The result of the logical OR operation between the stored code bit and the received code bit is left within the R register of one-bit processor 82. If the received code bit is a logic "0" and thereby matches the stored code bit, then the result of the logical "OR" operation is also a logic "0"; conversely, if the received code bit is a logic "1", then the result of the logical OR operation will be a logic "1". Still referring to the first sheet of the Appendix, the STOC processor instruction stored at memory address OA causes the complement of the result remaining in the R register to the output from the Data port of one-bit processor 82 while additionally causing the Write output terminal of one-bit processor 82 to provide a positive-going pulse (see FIG. 4). Inverter 298 (see FIG. 5C) inverts the positive-going Write pulse for clocking data latch 86 on the negative-going edge of the Write pulse, as shown in FIG. 4. If the received code bit during the first code bit interval was a logic "0", then a logic "1" is clocked into data latch 86. This operation is designated by block 325 within FIG. 9.

Referring again to the first sheet of the Appendix, the next processor instruction cycle stored at memory address 0B is an RTN instruction which provides a clock pulse to power-on latch 40 for transferring the Q output of data latch 86 thereto. If the received code bit was a logic "0", as would be expected for a proper code bit transmission, then the logic "1" written into data latch 86 is transferred to power-on latch 40 for maintaining power switch 42 in conduction. In this event, one-bit processor 82 performs eight successive processor instructions corresponding to no operation and stored at memorv addresses 0C through 13 for timing out the remainder of the first code bit interval. The aforementioned processor operations are designated within FIG. 9 by block 326, diamond-shaped decision box 327 and the branch designated "YES" extending therefrom. If the received code bit was not a logic "0", then a logic "0" is transferred into power-on latch 40, and power switch 42 thereupon decouples the +6 volt battery from the processor circuit components, returning the receiver circuitry to the low current standby mode. The aforementioned operations are designated within FIG. 9 by the "NO" branch extending from box 327, arrow 328 extending into box 329, and arrow 330 extending from box 329 back toward starting point 317.

The operations performed during the second and third code bit intervals shown in FIG. 3 are similar to those operations depicted within FIG. 9 by blocks 322, 324, 325, 326 and 327, since the received code bit during the second and third code bit intervals should also be a logic "0" within the code bit pattern represented in FIG. 3. However, during the fourth code bit interval, the code bit pattern shown in FIG. 3 calls for a logic "1". The operations performed during this code bit interval by the processor circuitry are indicated within the second sheet of the Appendix. During the first seven processor instruction cycles of the fourth code bit interval, the processor is instructed to perform no operation. However, during the eighth processor cycle of the fourth code bit interval, corresponding to memory address 43, a logic "1" bit is provided by the Q7 output of memory 80 and routed through multiplexer 88 to the Data port of one-bit processor 82. During this processor instruction cycle, processor 82 performs an LDP instruction for loading the bit presented to the Data port into the R register of processor 82. This operation is designated within FIG. 9 by block 331. The next processor instruction stored at memory address 44 causes the received code bit to be presented to the Data port of processor 82 and instructs processor 82 to perform a logical AND operation between the stored code bit previously loaded into the R register and the received code bit presented to the Data port of processor 82; the result of the logical AND operation is left within the R register of processor 82. These operations are designated within FIG. 9 by block 332.

During the second and all subsequent code bit intervals, the contents of data latch 86 should always be a logic "1" if the proper code bit pattern is being received. As an optional and further safeguard to insure that the proper code bit pattern is being received, the second and all subsequent code bit intervals may include a processor instruction cycle wherein, following the comparison of the received and stored code bits, (i.e., blocks 324 and 332), a further test is made to ensure that the contents of data latch 86 as determined by the previous code bit interval is still a logic "1". With reference to the second sheet of the Appendix, this further test is effected by the processor instruction stored at memory address 45 wherein the output of data latch 86 is routed through multiplexer 88 to the Data port of processor 82 and wherein processor 82 performs a logical AND between the result left remaining in the R register following the previous processor instruction and the contents of data latch 86. Since both the result left remaining in the R register from the previous processor instruction and the contents of data latch 86 should be a logic "1", then the result of the logic AND operation should also be a logic "1". This further test is designated within FIG. 9 by block 333. The result of this logic AND operation effected by the processor instruction stored at memory address 45 is again left remaining in the R register of processor 82. A similar test may be performed during those code bit intervals following the first code bit interval during which a logic "0" bit is expected by substituting an ORC processor instruction in place of the NO operation instruction described above at memory location 09, which instruction performs a logical OR operation between the complement of the contents of data latch 86 and the contents of the R register.

By using such an optional safeguard, processor 82 not only compares the stored code bit and received code bit for each code bit interval but also performs a cumulative comparison for all previous code bit intervals.

Still referring to the second sheet of the Appendix, the processor instruction stored at memory address 46 stores the contents of the R register within data latch 86 by providing a positive-going Write pulse and providing the contents of the R register within processor 82 to the Data port thereof. This step is represented within FIG. 9 by block 334. The processor instructions stored at memory addresses 47–4F correspond identically with those stored at memory addresses 0B–13, respectively. Thus, as described in reference to the first code bit interval, processor 82 causes the output of data latch 86 to be transferred to power-on latch 40 (represented within FIG. 9 by block 335). If a logic "1" is transferred to power-on latch 40, then power switch 42 continues to couple the +6 volt battery to the processor components, designated within FIG. 9 by the "YES" branch extending from diamond-shaped box 336. Conversely, if the code bit received during the fourth code bit interval was not a logic "1" and hence did not match the stored code bit, then power switch 42 decouples the +6 volt battery from the processor components, designated within FIG. 9 by arrow 328', arrow 328, block 329, and arrow 330.

The processor instruction coding for the fifth through twelfth code bit intervals is similar to that previously described for the first and fourth code bit intervals, as determined by whether the received code bit is expected to be a logic "0" or a logic "1", respectively. The third sheet of the Appendix indicates the processor instructions stored in memory 80 for execution during the thirteenth code bit interval. As shown in FIG. 3, it is assumed that the code bit received during the thirteenth code bit interval is a logic "1". The first thirteen processor instructions executed during the thirteen code bit interval (stored at memory addresses F0–FC) are identical with those indicated for the first thirteen processor instruction cycles shown in the second sheet of the Appendix for the fourth code bit interval. Thus, following the loading of the thirteenth stored code bit from memory into the R register of processor 82 (represented in FIG. 9 by block 337), the same operations are performed as those designated during the fourth code bit interval by blocks 332–336 within FIG. 9. As shown in the third sheet of the Appendix, the processor instruction stored at memory address FE is a skip if 0 (SKZ) instruction which causes processor 82 to ignore the next processor instruction if the R register thereof is equal to 0; if the R register of processor 82 were in fact equal to 0, then power switch 42 should have already decoupled the +6 volt battery from processor 82 before memory 80 is sequenced to memory address FE. Thus, since the R register should contain a logic "1" if the processor reaches memory address FE, the condition for the skip operation is not met, and the JNP instruction stored at memory address FF is subsequently executed by processor 82. This operation is designated within FIG. 9 by the "YES" branch extending from diamond-shaped box 338 and block 339. As described above, the positive-going pulse provided by the JMP output terminal of processor 82 during the JMP processor instruction cycle causes a logic "1" to be clocked into correct code latch 84 for permanently retaining data latch 86 in a set condition and thereby maintaining power switch 42 in conduction thereafter. This operation is designated within FIG. 9 by block 340. The remainder of the processor instructions shown on the third sheet of the Appendix at memory addresses 100–104 simply designate no operation.

So long as the 2.083 KHz signal continues to be received at 160 millisecond intervals, as shown in FIG. 3, the address counter register 78 and address counter extension 78' (see FIG. 5B) continue to be reset at 160 millisecond intervals. This circumstance is designated within FIG. 9 by the feedback branch labelled "NO" extending from diamond-shaped box 341. Once the 2.083 KHz signal diminishes, as when the receiver circuit leaves the field of the 2.083 KHz signal, then address counter extension 78' functions to provide a five second time delay before triggering the squib firing circuit, as designated within FIG. 9 by block 342 and stop terminal 343.

Transmitter Circuitry

Figure 6:
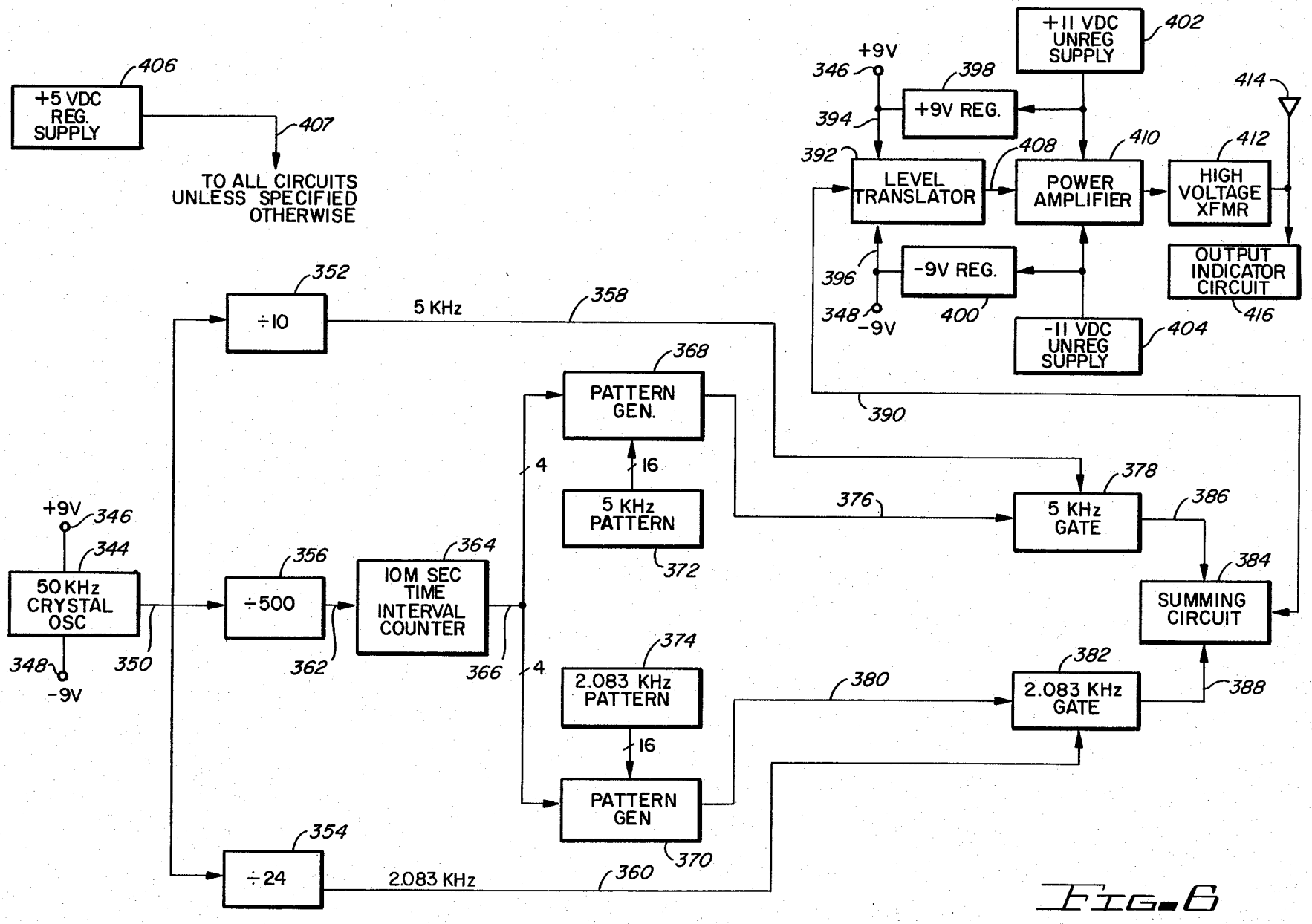
FIG. 6 is a block diagram of the transmitter circuitry utilized in preferred embodiment of the present invention.

The block diagram of FIG. 6 provides a general overview of the transmitter circuitry utilized in the preferred embodiment of the present invention to generate the 2.083 KHz and coded 5 KHz signals transmitted in the vicinity of the exits from the protected premises. It will be recalled that one of the objects of the present invention is to eliminate the need to tune the transmitted frequencies at the factory or during periodic service intervals. In this regard, a crystal oscillator circuit 344 is provided in the transmitter circuit and is powered from +9 volt and −9 volt regulated supply terminals 346 and 348. In the preferred embodiment of the present invention, crystal oscillator circuit 344 provides a 50 KHz clock signal, matching that of 50 KHz crystal oscillator 64 within the above-described receiver circuitry. 50 KHz crystal oscillator 344 provides a square wave output signal having a period of twenty microseconds, as shown in the uppermost wave form within FIG. 8. The 50 KHz clock signal is coupled by conductor 350 to the input of a divide-by-ten counter 352, to the input of a divide-by-twenty-four counter 354, and to the input of divide-by-500 counter 356. The output of divide-by-ten counter 352 is coupled to conductor 358 and provides an output signal thereto having a frequency of 5 KHz. The output of divide-by-24 counter 354 is coupled to conductor 360 and provides a 2.083 KHz signal. The output of divide-by-500 counter 356 is coupled by conductor 362 to the input of a ten millisecond time interval counter 364 and provides a 100 Hz clock signal thereto. The aforementioned 100 Hz clock signal is depicted within FIG. 8 immediately below the 50 KHz clock wave form. Thus, the 100 Hz clock signal has a period equal to the duration of one code bit interval, or ten milliseconds.

Still referring to FIG. 6, interval counter 364 is a four-bit binary counter responsive to the 100 Hz clock signal for providing a four-bit code address which is incremented by one during each ten millisecond period of the 100 Hz clock signal. The four-bit code address generated by interval counter 364 is coupled by four conductors collectively designated by reference numeral 366 to the four-bit code selection input terminals of pattern generator blocks 368 and 370. The four-bit code address cycles through sixteen distinct states, each such state having a duration of ten milliseconds. Consequently, the code address cycle is repeated every 160 milliseconds, corresponding to the 160 millisecond of the 2.083 KHz and 5 KHz coded signals shown in FIG. 3 in conjunction with the aforementioned receiver circuitry.

Pattern generator 368 includes sixteen binary input terminals programmed by 5 KHz pattern block 372. Similarly, pattern generator 370 includes sixteen input terminals programmed by 2.083 KHz pattern block 374. Pattern generators 368 and 370 each operate to select one of the sixteen programmed pattern bits as determined by the code address and provide the selected programmed bit as a gating signal at the output terminal of the respective pattern generator. The output terminal of pattern generator 368 is coupled by conductor 376 to a gating input of 5 KHz gate block 378. The gating signal provided by pattern generator 368 to 5 KHz gate 378 incorporates the pattern of logic "0"s and logic "1"s shown in FIG. 3 for the thirteen code bit intervals. 5 KHz gate 378 also includes a clocking input for receiving the 5 KHz clocking signal carried by conductor 358.

Similarly, the output terminal of pattern generator 370 is coupled by conductor 380 to the gating input of 2.083 KHz gate 382. The gating signal provided by pattern generator 370 is a logic "1" when the code bit address is binary 0000 and is a logic "0" for the fifteen other code addresses to effect a transmission of the 2.083 KHz signal during one of every sixteen successive ten millisecond periods. Gate block 382 also includes a clocking input coupled to conductor 360 for receiving the 2.083 KHz clocking signal.

Still referring to FIG. 6, 5 KHz gate 378 couples the 5 KHz clocking signal generated by counter 352, under the control of the gating signal provided by pattern generator block 368, to a first input of a summing circuit block 384 via conductor 386. Similarly, 2.083 KHz gate 382 couples the 2.083 KHz clocking signal provided by counter 354, under the control of the gating signal provided by pattern generator block 370, to a second input of summing circuit 384 via conductor 388. Summing circuit 384 forms the logical sum of the signals provided to it by conductors 286 and 388 and provides a summed output signal at the output terminal thereof.

The output terminal of summing circuit 384 is coupled by conductor 390 to the input terminal of level translator block 392. Level translator 392 is supplied with +9 volt and −9 volt power supply voltages via conductors 394 and 396, respectively. Conductors 394 and 396 are also coupled +9 volt supply terminal and −9 volt supply terminal 348, respectively, for powering crystal oscillator 344. The aforementioned +9 volt and −9 volt power supply voltages are provided by voltage regulator circuits 398 and 400, respectively; voltage regulators 398 and 400 are driven by +11 volt unregulated supply 402 and −11 volt unregulated supply 404, respectively. As shown in FIG. 6, a +5 volt DC regulated voltage supply 406 is also provided within the transmitter to power all other components therein.

The summed output signal provided by conductor 390 to the input terminal of level translator 392 is a voltage which switches between a low level of approximately ground potential and a high level of approximately +5 volts. The output of level translator 392 is coupled by conductor 408 to the input of a power amplifier 410 powered from +11 volt unregulated supply 402 and −11 volt unregulated supply 404. The signal provided to the input of power amplifier of 410 by level translator 392 is derived from the summed output signal provided by summing circuit 384. Power amplifier 410 amplifies the summed signal provided to its input and provides the amplified signal to the input of a high voltage transformer 412. The output of high voltage transformer 412 is coupled to an antenna 414 for radiating the summed first and second clocking signals as electromagnetic radio waves in the vicinity of the exits from the protected premises. As further shown in FIG. 6, the output of high voltage transformer 412 may also be coupled to the input of an output indicator circuit 416 for providing an indication that the output signal is being transmitted.

Still referring to FIG. 6, power amplifier 410 operates most efficiently when its input terminal receives a bipolar input signal which switches symmetrically above and below ground potential. The function of level translator circuit 392 is to convert the voltage levels provided by summing circuit 384 to a bipolar signal suitable for driving power amplifier 410. Level translator 392 is also adapted to provide a voltage substantially equal to ground potential to the input of power amplifier 410 when neither the 2.083 KHz signal nor the 5 KHz signal is to be transmitted by antenna 414, in order to minimize power consumed by power amplifier 410.

Figure 7A:
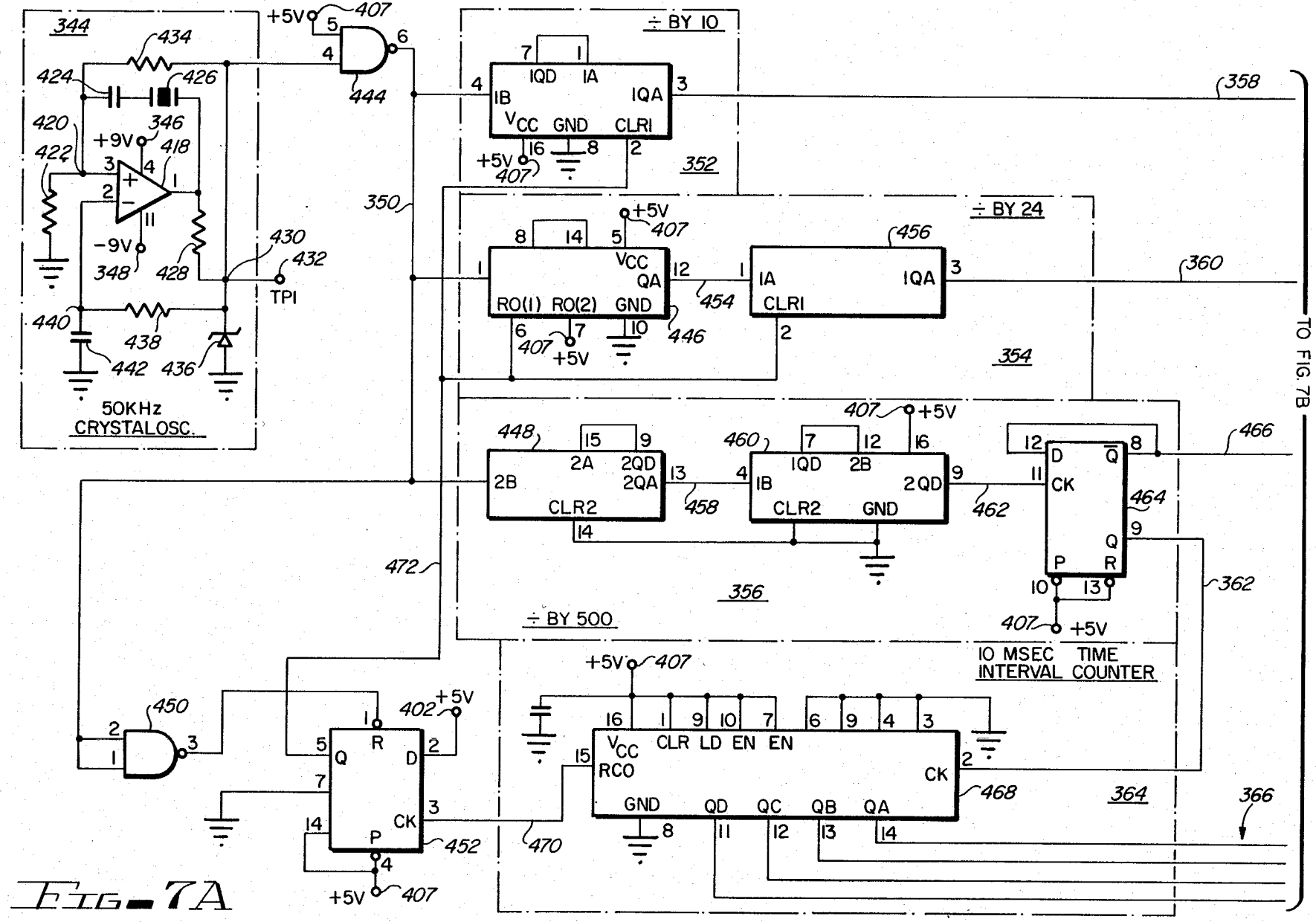
FIGS. 7A–7C together form a circuit schematic of the transmitter circuitry shown in block form within FIG. 6.

Referring now to FIG. 7A, 50 KHz crystal oscillator 344 is shown in greater detail. Operational amplifier 418 may be of the type provided by integrated circuit type LF347N, and the pin connections illustrated in FIG. 7A for operational amplifier 418 correspond to such an integrated circuit type. Op amp 418 includes a positive voltage supply input (pin 4) coupled to +9 volt supply terminal 346, as well as a negative voltage supply input (pin 11) coupled to −9 volt supply terminal 348. The non-inverting input (pin 3) of op amp 418 is coupled to node 420. Resistor 422 is coupled between node 420 and ground. Node 420 is also coupled to a first end of capacitor 424, the second end of which is coupled to one end of 50 KHz crystal 426. The opposite end of crystal 426 is coupled to the output terminal (pin 1) of op amp 418. The output terminal of op amp 418 is also coupled by resistor 428 to node 430. Node 430 is coupled to a test point 432 (TP1) which may be used during manufacture to test the output frequency of crystal oscillator 344. Node 430 is also coupled by resistor 434 to node 420. Zener diode 436, having a breakdown voltage of approximately 4.3 volts, is coupled between node 430 and ground to prevent the output voltage at node 430 from rising substantially above 4.3 volts. Resistor 438 extends from node 430 to node 440. Node 440 is, in turn, coupled to the inverting input terminal (pin 2) of op amp 418 and is also coupled by capacitor 442 to ground.

Node 430 of crystal oscillator 344 is coupled to a first input (pin 4) of a NAND gate 444. NAND gate 444 may be a portion of integrated circuit type 74LS00. The second input (pin 5) to NAND gate 444 is connected directly to the +5 volt supply terminal 407. NAND gate 444 thereby serves as an inverter and squaring circuit for squaring the output of 50 KHz oscillator circuit 344. The output terminal of NAND gate 444 is coupled by conductor 350 to a clocking input (pin 4) of an integrated circuit type 74LS390 within divide-by-ten block 352, to the clocking input (pin 1) of a divide-by-twelve counter 446 formed by integrated circuit type 74LS92 within divide-by-24 block 354, and to the clocking input (pin 12) of a divide-by-ten counter formed by integrated circuit type 74LS390 within divide-by-500 block 356. Conductor 350 is also coupled to a first input (pin 1) and a second input (pin 2) of a NAND gate 450 which may be formed from a portion of integrated circuit type 74LS00. The output terminal (pin 3) of NAND gate 450 is coupled to the Reset input (pin 1) of a clocked Data flip-flop 452 used to provide a reset pulse to divide-by-ten block 352 and divide-by-24 block 354 in a manner described in greater detail below.

Still referring to FIG. 7A, divide-by-ten counter 352 is programmed by coupling input 1A (pin 1) to output terminal 1QD (pin 7) whereby output terminal 1QA (pin 3) provides an output clocking signal having 1/10th the frequency of the 50 KHz input clocking signal. Output terminal 1QA is coupled to conductor 358 for providing the 5 KHz clocking signal thereto.

Divide-by-twelve counter 446 within block 354 is programmed by coupling input terminal A (pin 14) to output terminal QD (pin 8) for causing QA output terminal (pin 12) to provide an output signal of 1/12th the frequency of the 50KHz clocking signal. Output terminal QA of counter 446 is coupled by conductor 454 to the clocking input terminal (pin 1) of divide-by-two counter 456 within block 354, which counter may be of integrated circuit type 74LS390. The 1QA output terminal (pin 3) of counter 456 is coupled to conductor 360 for providing a 2.083 KHz clocking signal thereto.

Still referring to FIG. 7A, divide-by-ten counter 448 within divide-by-500 block 356 is programmed by coupling input terminal 2A (pin 15) to output terminal 2QD (pin 9) for causing a 5 KHz signal to be provided at the 2QA output terminal (pin 13) of counter 448. Conductor 458 couples the 5 KHz signal provided at the 2QA output terminal of counter 448 to the clocking input (pin 4) of a divide-by-25 counter 460 formed by an integrated circuit type 74LS390. Counter 460 is programmed by coupling input terminal 2D (pin 12) to output terminal lQD (pin 7) for providing a 200 Hz signal at output terminal 2QD (pin 9). Conductor 462 couples the 200 Hz signal provided by the 2QD output terminal of counter 460 to the Clock input (pin 11) of a clocked data flip-flop 464 formed by an integrated circuit type 74LS74. The $\overline{Q}$ output terminal (pin 8) of flip-flop 464 is coupled to the Data input (pin 12) thereof for causing flip-flop 464 to toggle output states each time the Clock input thereof receives a clock pulse. The $\overline{Q}$ output of flip-flop 464 is also coupled to conductor 466. Thus, conductor 466 provides a 100 Hz signal.

The Q output terminal (pin 9) of flip-flop 464 is coupled by conductor 362 to the Clock input (pin 2) of a divide-by-16 counter 468 within ten millisecond time interval counter 364. Divide-by-16 counter 468 may be an integrated circuit type 74LS161A. Counter 468 provides a four-bit binary word or code address at output terminals QD (pin 11), QC (pin 12), QB (pin 13) and QA (pin 14). The four conductors coupled to the aforementioned four output terminals are collectively designated within FIG. 7A by reference numeral 366. Counter 468 is clocked every ten milliseconds and cycles through sixteen code addresses, for a total of 160 milliseconds, before repeating the address code cycle.

Figure 8:
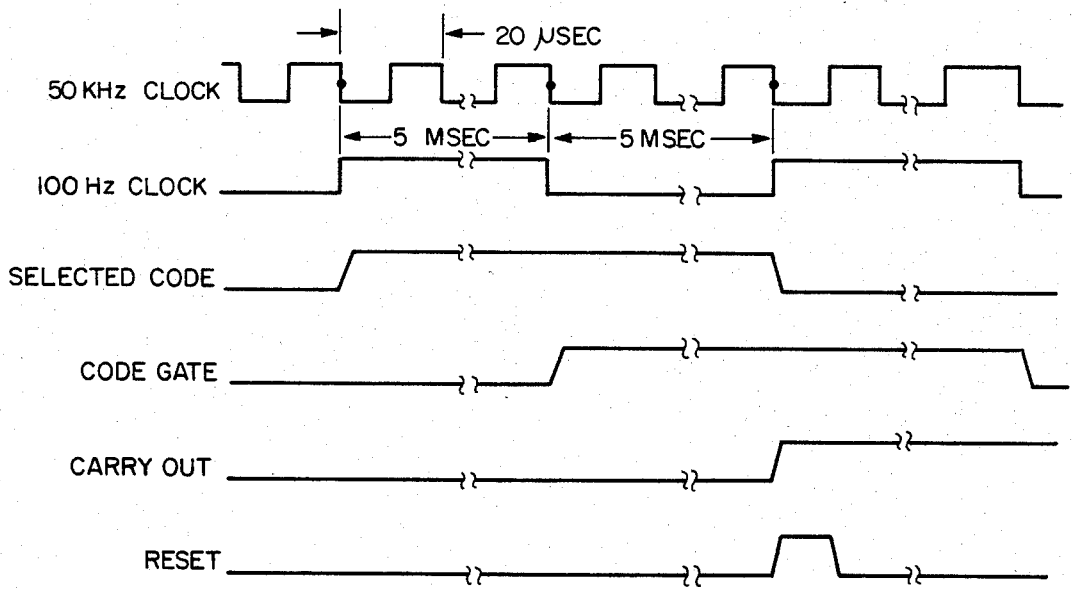
FIG. 8 is a timing diagram showing various clock signals and output wave forms generated by the transmitter circuitry.

With reference to FIG. 7A, divide-by-16 counter 468 includes a ripple carry out (RCO pin 15) which may be used to generate a reset pulse for synchronizing the divide-by-ten counter 352 and divide-by-24 counter 354 with the beginning of each 160 millisecond code frame; in this manner, the 2.083 KHz and 5 KHz signals provided by the transmitter circuitry are more easily observed upon a test oscilloscope. The RCO output terminal of counter 468 is coupled to the Clock input terminal (pin 3) of flip-flop 452 by conductor 470 and applies a positive-going pulse edge thereto, as shown in FIG. 8 for "Carry Out", each time the binary count stored within counter 468 reaches binary 1111 (decimal 15). The Data input terminal (pin 2) of flip-flop 452 is connected directly to +5 volt supply terminal 407 for receiving a logic "1" level. As described above, the Reset input terminal of flip-flop 452 is coupled to the output terminal of NAND gate 450 and receives the complement of the 50 KHz clocking signal distributed by conductor 350. Thus, flip-flop 452 is reset during each 50 KHz period. Consequently, the Q output terminal (pin 5) of flip-flop 452 is normally maintained at a low level. The Q output terminal of flip-flop 452 is coupled by conductor 472 to the Clear (pin 2) input terminal of divide-by-ten counter 352, to the Clear input terminal (pin 2) of divide-by-two counter 456, and to a Reset input terminal (pin 6) of divide-by-12 counter 446. Each of the aforementioned counters is cleared or reset by the positive-going transition of the reset signal generated by the Q output terminal of flip-flop 452.

Still referring to FIG. 7A, those skilled in the art will appreciate that, at the point in time when ten millisecond counter 468 is incremented to the binary "1111" state and the ripple carry out signal is generated therefrom, the 50 KHz clocking signal distributed by conductor 350 has switched to a low level, as shown in FIG. 8. Accordingly, the signal then applied to the Reset input terminal of flip-flop 452 is a high level, whereas, the Reset input terminal to flip-flop 452 is active-low. Thus, at the point in time when the ripple carry out positive-going edge is provided to the Clock input of flip-flop 452, a logic "1" level is clocked to the Q output terminal thereof for resetting divide-by-ten counter 352 and divide-by-24 block 354. Upon the return of the 50 KHz clocking signal distributed by conductor 350 to a high level, flip-flop 452 is again reset, causing the signal provided by the Q output terminal thereof to return to a logic "0" level, as shown in FIG. 8. It should be clear from the foregoing that the reset pulse provided by the Q output of flip-flop 452 has a duration of one-half of the period of the 50 KHz clocking signal; as a result, no gaps appear within either the 5 KHz clocking signal provided by divide-by-ten counter 352 or within the 2.083 KHz signal provided by divide-by-24 block 354.

Figure 7B:
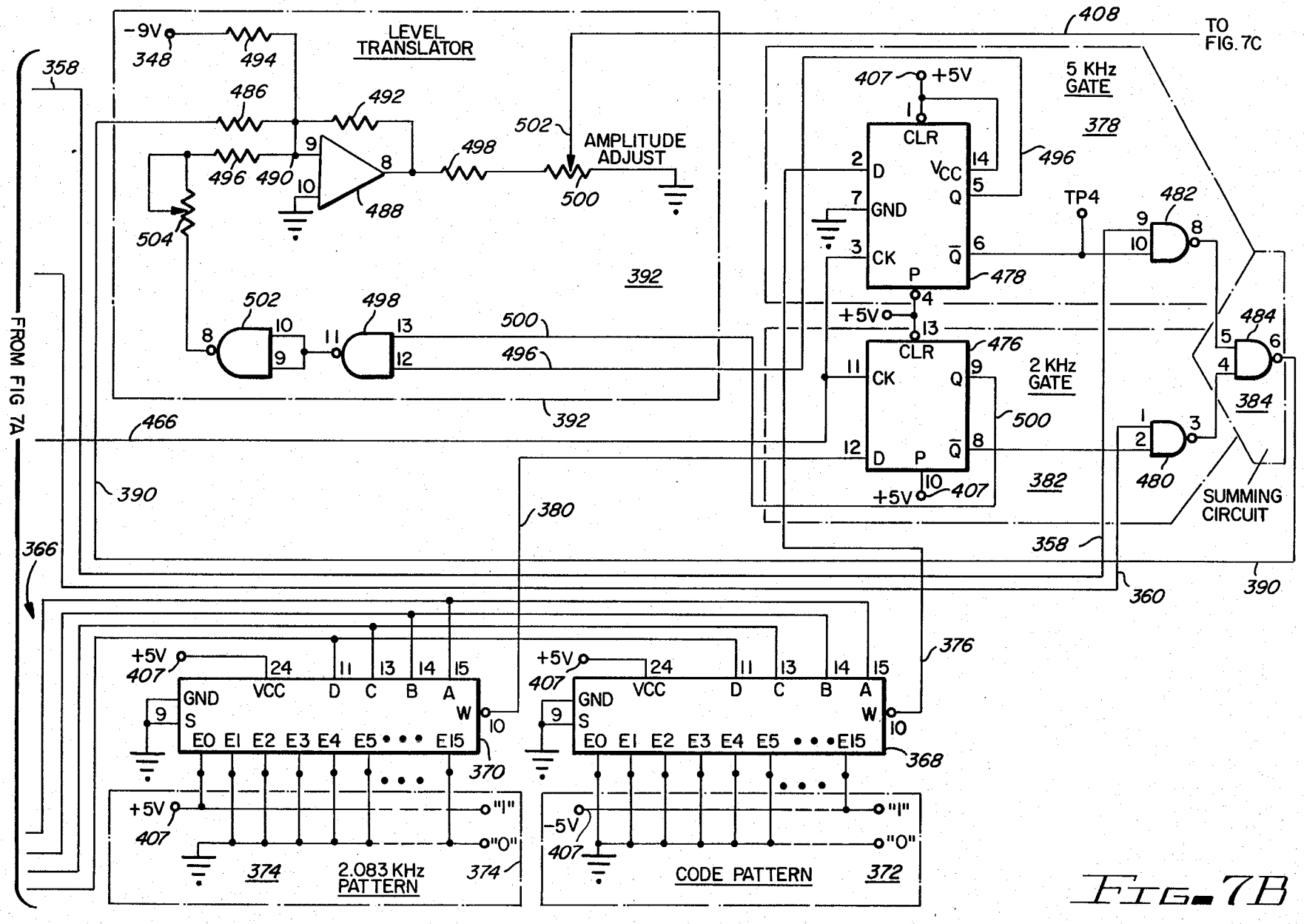

With reference to FIG. 7B, the four-bit binary code address generated by ten millisecond time interval counter 364 is coupled by conductors 366 to the address input terminals D (pin 11), C (pin 13), B (pin 14), and A (pin 15) of two identical one-of-16 data selectors 368 and 370 for generating the 5 KHz code gating signal and the 2.083 KHz gating signal, respectively. In the preferred embodiment of the present invention, such one-of-16 data selectors are of the type formed by an integrated circuit type 74150, and the pin numbers shown in FIG. 7B correspond to such integrated circuit type. Each of data selectors 368 and 370 includes sixteen data terminals designated E0–E15. The data input terminals E0–E15 of data selector 368 are each coupled to a corresponding output terminal of 5 KHz code pattern block 372. Similarly, the E0–E15 data input terminals of data selector 370 are each coupled to a corresponding output terminal of 2.083 KHz pattern block 374. Each output terminal within 5 KHZ code pattern block 372 and within 2.083 pattern block 374 is either coupled to a logic "1" line connected to the +5 volt supply terminal 407 or to a logic "0" line coupled to ground. Those skilled in the art will appreciate that the code patterns programmed within blocks 372 and 374 correspond to the transmission or absence thereof of the 2.083 KHz and 5 KHz signals during the sixteen 10 millisecond time intervals illustrated within FIG. 3 for one 160 millisecond code frame.

Each of data selectors 368 and 370 includes a W output terminal (pin 10) for providing the complement of the data input selected by the current code address DCBA. For example, if the code address DCBA is "0000", corresponding to the first ten millisecond time interval within the receiver recovery period illustrated in FIG. 3, then data selector 370 selects a logic "1" input from the E0 input terminal, while data selector 368 selects a logic "0" from the E0 terminal. Since the W output terminal of each of the data selectors 368 and 370 complements the selected data input, a logic "0" is provided by the W output terminal of data selector 370, while a logic "1" is provided by the W output terminal of data selector 368.

As shown in FIG. 7B, the W output terminal of data selector 70 is coupled by conductor 380 to the Data input terminal (pin 12) of clocked data flip-flop 476 within 2.083 KHz gate 382. Similarly, the W output terminal of data selector 368 is coupled by conductor 376 to the Data input terminal (pin 2) of clocked data flip-flop 478 within 5 KHz gate 378. Flip-flops 476 and 478 may be provided by a single integrated circuit type 74LS74. Flip-flop 476 includes a Clock input terminal (pin 11), and flip-flop 478 also includes a Clock input terminal (pin 3), each of which is coupled to conductor 466 for receiving a 100 Hz clock signal which is the complement of the 100 Hz clock signal provided to ten millisecond time interval counter 364 (see FIG. 7A). Flip-flops 476 and 478 are clocked on the positive-going edge of the signal received by their respective clocking input terminals. Accordingly, the gating signals supplied by conductors 376 and 380 to flip-flops 478 and 476, respectively, are clocked into flip-flops 478 and 476 at a point in time corresponding to one-half clock cycle of the 100 Hz clock bevond that of the clock signal supplied to ten millisecond time interval counter 364.

Still referring to FIG. 7B, the $\overline{Q}$ output terminal (pin 8) of flip-flop 476 is coupled to a first input terminal (pin 2) of NAND gate 480. Similarly the $\overline{Q}$ output terminal (pin 6) of flip-flop 478 is coupled to a first input terminal (pin 10) of NAND gate 482. The output terminal (pin 3) of NAND gate 480 is coupled to a first input terminal (pin 4) of a further NAND gate 484 forming summing circuit 384, while the output terminal (pin 8) of NAND gate 482 is coupled to the second input terminal (pin 5) of NAND gate 484. NAND gates 480, 482, and 484 may all be provided by a single integrated circuit type 74LS00.

As shown in FIG. 7B, the second input terminal (pin 1) of NAND gate 480 is coupled to conductor 360 for receiving the 2.083 KHz clocking signal provided by divide-by-24 block 354. Similarly, the second input terminal (pin 9) is coupled to conductor 358 for receiving the 5 KHz clocking signal provided by divide-by-ten counter 352. NAND gate 480 serves to selectively gate the 2.083 KHz clocking signal to summing circuit 384, and NAND gate 482 selectively gates the 5 KHz clocking signal to summing circuit 384. NAND gate 484 within summing circuit 384 combines the gated clocking signals and provides a summed output signal at its output terminal (pin 6). Conductor 390 couples the output terminal of NAND gate 484 to a first end of an input resistor 486 within level translator block 392, the construction and operation of which will now be described.

With reference to FIG. 7B, level translator 392 includes an operational amplifier 488 which may be of the type provided by integrated circuit LF347N. Op amp 488 includes an inverting input terminal (pin 9), a non-inverting input terminal (pin 10) and an output terminal (pin 8). The non-inverting input terminal of op amp 488 is coupled to ground, while the inverting input terminal thereof is coupled to node 490 and to the second end of input resistor 486. A feedback resistor 492 is coupled between node 490 and the output terminal of op amp 488. Node 490 is also coupled by current sink resistor 494 to −9 volt supply terminal 348. Node 490 is further coupled to a first end of resistor 496, which resistor forms a portion of a zero level control circuit, the operation of which is described in greater detail below; during those ten millisecond time intervals during which either the 2.083 KHz signal or the 5 KHz signal are being transmitted, the aforementioned zero level control circuit has little effect upon level translator block 392. The output terminal of op amp 488 is coupled through a fixed value resistor 498 and through a variable tap resistor 500 to ground. The center tap terminal 502 of center tapped resistor 500 is used to adjust the amplitude of the output signal coupled to conductor 408 for coupling to the signal input of power amplifier block 410 (see FIG. 7C).

With reference to level translator 392 within FIG. 7B, current sink resistor 494, having a value of 91 K ohms, sinks a current from node 490 of approximately 0.1 mA. The summed output signal provided by NAND gate 484 switches between TTL voltage levels of approximately 0.2 volt (for a low level) and 3.5 volts (for a high level). It will be recalled that an objective of level translator circuit 392 is to convert such TTL switching levels to a bipolar signal centered approximately about ground potential. Accordingly, the value of resistor 486 is selected such that the current source to node 490 by resistor 486 when the summed output signal is at a high level is approximately twice the magnitude of the current withdrawn from node 490 by current sink resistor 494. In this manner, the current drawn across feedback resistor 492 in order to maintain node 490 at a virtual ground potential switches between positive and negative values of a magnitude approximating the current withdrawn from node 490 by current sink resistor 494. In this manner, the output voltage provided at the output terminal of op amp 488 approximates a bipolar voltage.

In the event that neither the 2.083 KHz signal nor the 5 KHz signal is to be transmitted during a particular ten millisecond interval (for example, during the first code bit interval shown in FIG. 3), then the summed output signal produced by summing circuit 384 will be a TTL low level, or approximately 0.2 volt. However, this would result in a negative voltage at the output terminal of op amp 488, which, in turn, causes excessive power to be needlessly consumed within power amplifier 410. In order to prevent such unnecessary wasting of power within power amplifier 410 during ten millisecond intervals when no signal is to be transmitted, level translator circuit 392 incorporates a zero level control mechanism which selectively sources current to node 490 to compensate for current withdrawn therefrom by current sinking resistor 494. During those periods when the 5 KHz signal is not to be transmitted, the Q output terminal (pin 5) of flip-flop 478 within 5 KHz gate block 378 is at a logic "1". Similarly, during those periods when the 2.083 KHz signal is not to be transmitted, the Q output terminal (pin 9) of flip-flop 476 within 2.083 KHz gate block 382 is also at a logic "1". Conductor 496 couples the Q output terminal of flip-flop 478 to a first input terminal (pin 12) of NAND gate 498. Similarly, conductor 500 couples the Q output terminal of flip-flop 476 to second input terminal (pin 13) of NAND gate 498. The output terminal (pin 11) of NAND gate 498 is coupled to the first and second input terminals (pins 9 and 10, respectively) of NAND gate 502. NAND gates 498 and 502 may each be provided by a single integrated circuit type 74LS00. The output terminal (pin 8) of NAND gate 502 is coupled to a first end of variable resistor 504, the opposite end of which is coupled to the end of resistor 496 opposite node 490. If both the Q output terminal of flip-flop 478 and flip-flop 476 are each a logic "1", indicating that no signal is to be transmitted by the transmitter, then the voltage at the output terminal of NAND gate 502 will be approximately equal to +3.7 volts. Resistors 504 and 496 are selected to source a current of approximately 0.1 mA to node 490 for supplying a current of approximately the same magnitude as that withdrawn by current sinking resistor 494. In this event, the current conducted by feedback resistor 492 is substantially equal to zero, and hence, the voltage supplied to the input of power amplifier 410 is also equal to zero for minimizing power consumed therein. Conversely, if either the 5 KHz signal or the 2.083 KHz signal is to be transmitted during a particular ten millisecond interval, then the output terminal of NAND gate 502 is switched to a low level (approximately ground potential), and resistors 504 and 496 therefore do not source or sink a significant amount of current from node 490. Thus, the zero level control circuit formed by NAND gate 498 and 502 and resistors 504 and 496 form a switchable current source responsive to the 5 KHz and 2.083 KHz gating signals for selectively inhibiting the action of current sinking resistor 494.

Figure 7C:
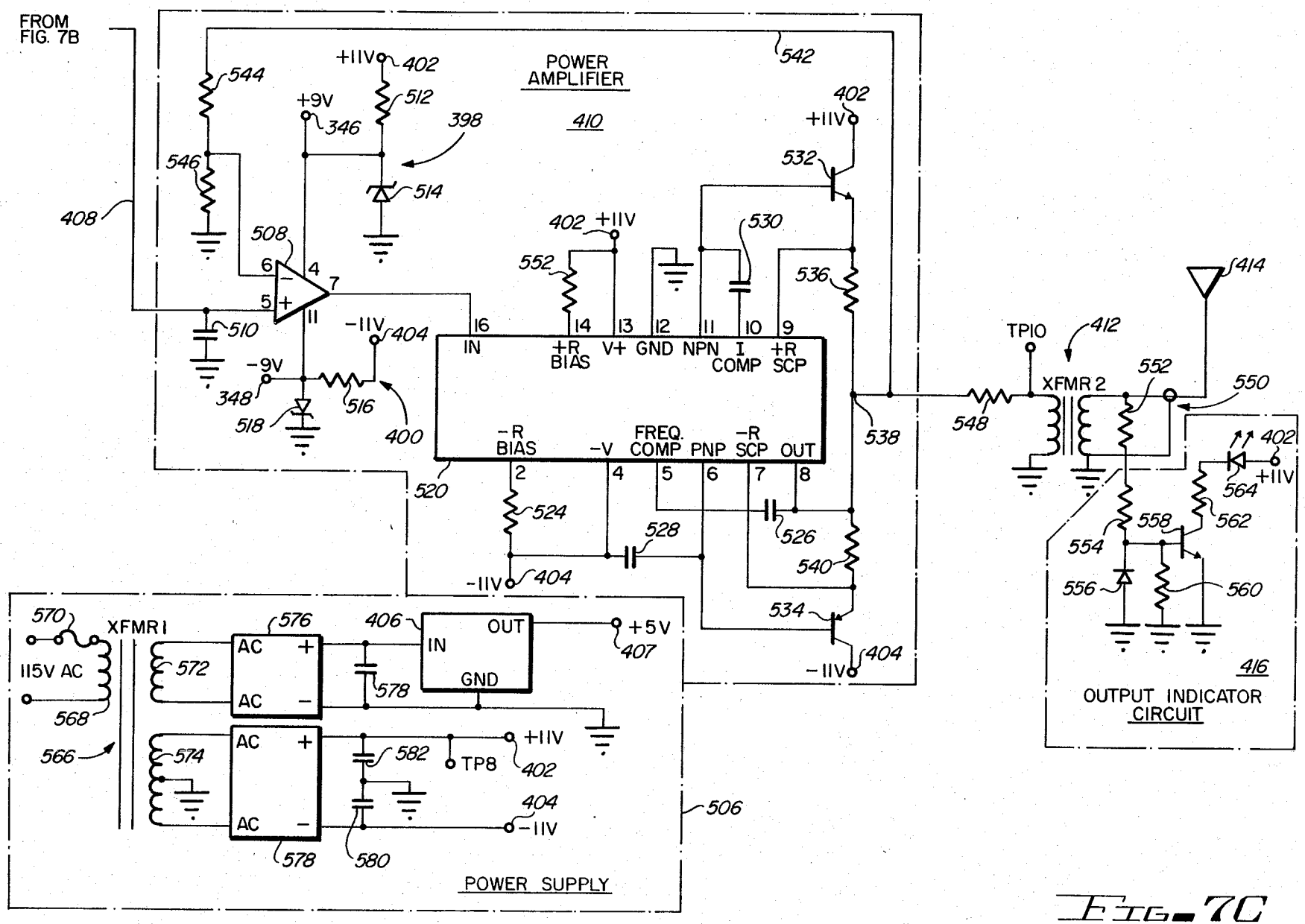

With reference to FIG. 7C, circuit details are provided in regard to power amplifier 410, high voltage transformer 412, output indicator circuit 416, as well as power supply circuitry 506 In regard to power amplifier 410, conductor 408 is coupled to the non-inverting input terminal (pin 5) of an operational amplifier 508 which may be of the type provided by integrated circuit type LF347N. Conductor 408 is also coupled through capacitor 510 to ground. Op amp 508 includes a positive voltage supply terminal (pin 4) coupled to a regulated +9 volt supply terminal 346. As shown in FIG. 7C, the regulated +9 volt supply voltage is generated by a resistor 512 coupled between unregulated +11 volt supply terminal 402 and the first end of Zener diode 514 the second end of which is coupled to ground. Op amp 508 also includes a negative voltage supply terminal (pin 11) coupled to the −9 volt power supply terminal 348. The −9 volt regulated supply voltage is derived from the unregulated −11 volt supply terminal 404 by resistor 516 and Zener diode 518 in a manner similar to that for the +9 volt regulated supply.

The output terminal (pin 7) of op amp 508 is coupled to the input terminal (pin 16) of a further amplifier 520 which, in the preferred embodiment of the present invention, is provided by an integrated type ICL8063. Amplifier 520 is powered from the +11 volt supply terminal 402 and the −11 volt supply terminal 404, as shown in FIG. 7C. A positive bias resistor 522 is coupled between pin 14 and positive voltage input terminal pin 13; similarly, a negative bias resistor 524 is coupled between pin 2 and negative voltage supply input terminal pin 4. Frequency compensation capacitor 526 is coupled between frequency compensation pin 5 and OUT pin 8. A capacitor 528 is also coupled between PNP drive pin 6 and negative supply voltage pin 4. An additional capacitor 530 is coupled between PNP drive pin 11 and current compensation (I COMP) pin 10.

Amplifier 520 is used to drive NPN transistor 532 and PNP transistor 534 in a push-pull manner of operation. The collector terminals of transistors 532 and 534 are coupled to the +11 volt supply terminal 402 and −11 volt supply terminal 404, respectively. The base terminal of transistor 532 is coupled to NPN drive pin 11 of amplifier 520. Similarly, the base terminal of transistor 534 is coupled to PNP drive pin 6 of amplifier 520. The emitter terminal of transistor 532 is coupled through resistor 536 to output node 538, and the emitter terminal of transistor 534 is coupled through resistor 540 to output node 538 as well. The emitter terminal of transistor 532 is also coupled to the positive short circuit protection pin 9 of amplifier 520, and the emitter of transistor 534 is coupled to the negative short circuit protection pin 7 of amplifier 520. Output node 538 is coupled to OUT pin 8 of amplifier 520 and is also coupled by conductor 542 to a first end of feedback resistor 544, the second end of which is coupled to the inverting input terminal (pin 6) of op amp 508. Additionally, resistor 546 extends from the inverting input terminal of op amp 508 to ground.

Still referring to FIG. 7C, the amplified output signal provided at node 538 by transistors 532 and 534 is coupled through a 1 ohm resistor 548 to the primary windings of high voltage transformer 412. The secondary windings of transformer 412 are coupled through coaxial cable 550 to antenna 414. In the preferred embodiment of the present invention, the ratio of windings between the primary and secondary sides of transformer 412 is 1:100 whereby a 19.4 volt peak-to-peak voltage applied across the primary winding of transformer 412 effects an output signal within the secondary windings thereof of approximately 1940 volts peak-to-peak.

Also shown in FIG. 7C is an output indicator circuit 416 coupled to the secondary side of transformer 412 to provide a visual indication that a signal is being transmitted. Resistor 552 extends from the ungrounded terminal of the secondary coil of transformer 412 to the first end of a second resistor 554. The second end of resistor 554 is coupled to the cathode of a negative-voltage clamping diode 556, the anode of which is grounded. The cathode of diode 556 is coupled to the base terminal of switching transistor 558 and through a bleed off resistor 560 to ground. The emitter terminal of transistor 558 is grounded, while the collector terminal thereof is coupled through current limiting resistor 562 to the cathode of a light emitting diode 564, the anode of which is coupled to the +11 volt supply terminal 402. Whenever a bipolar signal is being driven over coax cable 550 to antenna 414, a bipolar voltage is applied to the base of transistor 558 sufficient to periodically switch transistor 558 into conduction for illuminating light emitting diode 564. Conversely, when no signal is being transmitted to antenna 414, then switching transistor 558 is turned off, as is light emitting diode 564.

Also shown in FIG. 7C is power supply block 506 which includes a transformer 566 having a primary winding 568 coupled through fuse 570 to a source of 115 volts A.C. Transformer 566 includes a pair of secondary windings 572 and 574. Secondary winding 572 provides a 6.3 volt A.C. output voltage which is applied to a full-wave bridge rectifier 576 which may be of the type commercially available as model number MDA100A. The negative output terminal of rectifier 576 is grounded, and the positive voltage output terminal is filtered by storage capacitor 578. The unregulated positive voltage produced at the positive output terminal of rectifier 576 is coupled to the input of a 3-terminal +5 volt regulator 406 which may be of the type commercially available as MC7805. The output terminal of regulator 406 is coupled to the +5 volt supply terminal 407.

Secondary winding 574 of transformer 566 includes a grounded center tap. The first and second ends of secondary winding 574 are coupled to the input terminals of a bridge rectifier circuit 578 of the type commercially available as MDA 980-2. Each AC input of bridge rectifier 578 is provided with a 9 volt A.C. signal. The negative output terminal of rectifier 578 is coupled to unregulated −11 volt supply terminal 404 and is filtered by capacitor 580. Similarly, the positive voltage output terminal of rectifier 578 is coupled to the +11 volt unregulated supply terminal 402 and is filtered by capacitor 582.

Those skilled in the art will now appreciate that a highly improved electronic security system has been described herein which system minimizes the drain of power from the battery installed within the receiver while remaining highly sensitive to radio signals transmitted in the vicinity of the exits from the bank. The described security system significantly reduces the possibility that the receiver will be falsely triggered by stray signals. Changes in the particular digital code used to trigger the receiver may easily be implemented by changing only the programmed instructions stored within the memory of the receiver circuit and by making corresponding changes within the code pattern blocks of the transmitter. Thus, the digitally coded signal may be easily and conveniently varied for a given user or as between several different users. The described security system provides a highly compact, lightweight and relatively inexpensive receiver while additionally minimizing the power requirements and physical size of the associated transmitter.

While the invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

A listing of the values of various components identified above within the specification is set forth below:

| Reference Numeral | Value or Type of Component |
|---|---|
| 160 | 5.1 Megohm |
| 162 | 1 Megohm |
| 162′ | 1 Megohm |
| 166 | 10 Megohm |
| 166′ | 10 Megohm |
| 168 | 3.6 Megohm |
| 170 | .1 microFarad |
| 170′ | 1000 picoFarad |
| 172 | 3 Megohm |
| 172′ | 6.8 Megohm |
| 174 | 1.8 Megohm |
| 174′ | 255K ohm |
| 178 | 20K ohm (variable) |
| 178′ | 20K ohm |
| 180 | 330 picoFarad |
| 180′ | 330 picoFarad |
| 182 | 5.1 Megohm |
| 182′ | 2 Megohm |
| 184 | 330 picoFarad |
| 184′ | 330 picoFarad |
| 186 | .01 microFarad |
| 186′ | 220 picoFarad |
| 188 | 150K ohm |
| 188′ | 200K ohm |
| 194 | 2.7 Megohm |
| 194′ | 1 Megohm |
| 196 | 27 pico Farad |
| 198 | .01 microFarad |
| 198′ | 220 picoFarad |
| 200 | 150K ohm |
| 200′ | 200K ohm |
| 206 | 510K ohm |
| 206′ | 1 Megohm |
| 208 | 1N4148 |
| 208′ | 1N4148 |
| 213 | 100K ohm |
| 214 | 2N5087 |
| 216 | 100K ohm |
| 218 | 1000 picoFarad |
| 220 | 200K ohm |
| 228 | 22 picoFarad |
| 234 | 15 Megohm |
| 236 | 22K ohm |
| 240 | 100 picoFarad |
| 242 | 100K ohm |
| 244 | 1N4148 |
| 248 | 1000 picoFarad |
| 250 | 5.1 Megohm |
| 280–284 | 100K ohm |
| 286–288 | 100K ohm |
| 290 | 10K ohm |
| 292 | 1N4148 |
| 294 | 2200 picoFarad |
| 296 | 1 Megohm |
| 300 | 1 Megohm |
| 302 | 10K ohm |
| 306 | 47K ohm |
| 308 | 2N5087 |
| 311 | 3K ohm |
| 312 | .1 microFarad |
| 314 | 2N5061 |

-continued

| Reference Numeral | Value or Type of Component |
|---|---|
| 422 | 56K ohm |
| 424 | 22 picoFarad |
| 428 | 510 ohm |
| 434 | 1 Megohm |
| 436 | 1N5229 |
| 438 | 17.8K ohm |
| 442 | 1000 picoFarad |
| 486 | 20K ohm |
| 492 | 20K ohm |
| 494 | 91K ohm |
| 496 | 36K ohm |
| 498 | 1K ohm |
| 500 | 10K ohm (variable) |
| 504 | 10K ohm (variable) |
| 510 | .01 microFarad |
| 512 | 100 ohm |
| 514 | 1N5239 |
| 516 | 100 ohm |
| 518 | 1N5239 |
| 522 | 220K ohm |

-continued

| Reference Numeral | Value or Type of Component |
|---|---|
| 524 | 220K ohm |
| 526 | 560 picoFarad |
| 528 | 5 picoFarad |
| 530 | 5 picoFarad |
| 532 | 2N6486 |
| 534 | 2N6489 |
| 536 | .20 ohm |
| 540 | .20 ohm |
| 544 | 47K ohm |
| 546 | 10K ohm |
| 548 | 1 ohm |
| 552 | 2.0 Megohm |
| 554 | 2.0 Megohm |
| 556 | 1N4148 |
| 558 | 2N5088 |
| 560 | 1 Megohm |
| 562 | 1K ohm |
| 578 | 4700 microFarad |
| 580 | 4700 microFarad |
| 582 | 4700 microFarad |

APPENDIX

MULTIPLEXER CTRL PATTERN DATA — SPARE CONTROL — PROCESSOR INSTRUCTIONS

| ADDRESS LOCATION | HEX DATA | Q7 | Q6 | Q5 | Q4 | Q3 | Q2 | Q1 | Q0 | INSTRUCTION CODE | COMMENTS |
|---|---|---|---|---|---|---|---|---|---|---|---|
| 00 | 9A | | | | | | | | | IEN | Enable input registers of 14500 |
| 01 | 9A | | | | | | | | | IEN | Enable input registers of 14500 |
| 02 | 9A | | | | | | | | | IEN | Enable input registers of 14500 |
| 03 | 9A | | | | | | | | | IEN | Enable input registers of 14500 |
| 04 | 9B | | | | | | | | | OEN | Enable output registers of 14500 |
| 05 | 9B | | | | | | | | | OEN | Enable output registers of 14500 |
| 06 | 9B | | | | | | | | | OEN | Enable output registers of 14500 |
| 07 | 11 | | | | | | | | | LDP | Load pattern into R register (0) |
| 08 | 35 | | | | | | | | | OR | Compare 5KHz code with R register |
| 09 | 7F | | | | | | | | | NOPF | No operation |
| 0A | 79 | | | | | | | | | STOC | Store complement of R register into U8 |
| 0B | 7D | | | | | | | | | RTN | Turn 6V-SW off if U8=0, I.E. code doesn't agr with stored code |
| 0C | 7F | | | | | | | | | NOPF | No operation |
| 0D | 7F | | | | | | | | | NOPF | No operation |
| 0E | 7F | | | | | | | | | NOPF | No operation |
| 0F | 7F | | | | | | | | | NOPF | No operation |
| 10 | 7F | | | | | | | | | NOPF | No operation |
| 11 | 7F | | | | | | | | | NOPF | No operation |
| 12 | 7F | | | | | | | | | NOPF | No operation |
| 13 | 7F | | | | | | | | | NOPF | No operation |
| 3C | FF | | | | | | | | | NOPF | No operation |
| 3D | FF | | | | | | | | | NOPF | No operation |
| 3E | FF | | | | | | | | | NOPF | No operation |
| 3F | FF | | | | | | | | | NOPF | No operation |
| 40 | FF | | | | | | | | | NOPF | No operation |
| 41 | FF | | | | | | | | | NOPF | No operation |
| 42 | FF | | | | | | | | | NOPF | No operation |
| 43 | 91 | | 0 | 0 | | | | | | LDP | Load pattern into R register (1) |
| 44 | B3 | | 0 | 1 | | | | | | AND | R register (1) ● stored pattern (1)→R register (1) |
| 45 | D3 | | 1 | 0 | | | | | | AND | R register (1) ● previous compare (U8)→R register (1) |
| 46 | F8 | | 1 | 1 | | | | | | STO | R register (1)→U8 (1) |
| 47 | FD | | | | | | | | | RTN | Power on if U8=1, off if U8=0 |
| 48 | FF | | | | | | | | | NOPF | No operation |
| 49 | FF | | | | | | | | | NOPF | No operation |
| 4A | FF | | | | | | | | | NOPF | No operation |
| 4B | FF | | | | | | | | | NOPF | No operation |
| 4C | FF | | | | | | | | | NOPF | No operation |
| 4D | FF | | | | | | | | | NOPF | No operation |
| 4E | FF | | | | | | | | | NOPF | No operation |
| 4F | FF | | | | | | | | | NOPF | No operation |
| F0 | FF | | | | | | | | | NOPF | No operation |
| F1 | FF | | | | | | | | | NOPF | No operation |
| F2 | FF | | | | | | | | | NOPF | No operation |
| F3 | FF | | | | | | | | | NOPF | No operation |
| F4 | FF | | | | | | | | | NOPF | No operation |
| F5 | FF | | | | | | | | | NOPF | No operation |
| F6 | FF | | | | | | | | | NOPF | No operation |
| F7 | 91 | | | | | | | | | LDP | Load pattern into R register (1) |
| F8 | B3 | | | | | | | | | AND | R register (1) ● stored pattern (1)→R register (1) |

APPENDIX-continued

| ADDRESS LOCATION | HEX DATA | MULTIPLEXER CTRL PATTERN DATA Q7 | Q6 | Q5 | SPARE CONTROL Q4 | Q3 | PROCESSOR INSTRUCTIONS Q2 | Q1 | Q0 | INSTRUCTION CODE | COMMENTS |
|---|---|---|---|---|---|---|---|---|---|---|---|
| F9 | D3 | | | | | | | | | AND | R register (1) ● previous compare (U8)→R register (1) |
| FA | F8 | | | | | | | | | STO | R register (1)→U8 (1) |
| FB | FD | | | | | | | | | RTN | Power on if U8=1, off if U8=0 |
| FC | FF | | | | | | | | | NOPF | No operation |
| FF | FE | | | | | | | | | SKZ | Skip "JMP" if R register=0 |
| FF | FC | | | | | | | | | JMP | Set power permanently on, all 13 bits agree |
| 100 | FF | | | | | | | | | NOPF | No operation |
| 101 | FF | | | | | | | | | NOPF | No operation |
| 102 | FF | | | | | | | | | NOPF | No operation |
| 103 | FF | | | | | | | | | NOPF | No operation |
| 104 | FF | | | | | | | | | NOPF | No operation |

I claim:

1. A security system for detecting the removal of an article from a premises to be protected, the protected premises including at least one exit through which the article may be removed from the protected premises, said security system comprising in combination:

a. a transmitter for transmitting first and second signals in the vicinity of said exit, said first signal being transmitted as a series of periodic pulses having a first predetermined period of time therebetween:

b. receiver means carried by said article, said receiver means including:

i. an electrical power source;

ii. a first receiver for detecting the presence of said first signal, said first receiver being continuously coupled to said electrical power source for continuously receiving electrical power therefrom, said first receiver generating an enabling signal upon detecting said first signal;

iii. a second receiver for detecting the presence of said second signal and providing an alarm in response thereto, said second receiver generating a disabling signal upon failing to detect said second signal within a second predetermined period of time after said enabling signal is generated, said second predetermined period of time being shorter than said first predetermined period of time; and iv. power switching means responsive to said enabling and disabling signals for selectively electrically coupling said electrical power source to said second receiver following the generation of said enabling signal and decoupling said electrical power source from said second receiver means following the generation of said disabling signal for lessening the amount of electrical power drained from said electrical power source during instances when said receiver means is exposed to said first signal in the absence of said second signal.

2. A security system as recited by claim 1 wherein said first and second signals are transmitted as electromagnetic radio waves of first and second frequencies, respectively, and wherein said first receiver includes a first filter for passing signals of said first frequency and said second receiver means includes a second filter for passing signals of said second frequency.

3. A security system as recited by claim 2 wherein said first filter is an active filter comprising:

a. a first current programmable operational amplifier having an inverting input terminal and an output terminal and including a first feedback resistor of a first magnitude coupled therebetween;

b. a second current programmable operational amplifier having an inverting input terminal coupled to the output of said first operational amplifier, said second operational amplifier having an output terminal;

c. a second feedback resistor coupled between the output terminal of said second operational amplifier and the inverting input terminal of said first operational amplifier, the ratio of the magnitude of the first feedback resistor to the magnitude of the second feedback resistor being greater than unity to increase the selectivity of said first filter; and d. said first and second operational amplifiers are programmed to operate at substantially minimum current levels to minimize power drawn from said electrical power source and to minimize the bandwidth of the gain provided by each of said first and second operational amplifiers to increase the selectivity of said first filter and to decrease the tendency of said first filter to oscillate.

4. A security system as recited by claim 1 wherein said power switch means includes a clocked data latch having a forced-state input, a clock input, a data input, and an output, said clocked data latch being coupled to said electrical power source for being continuously powered thereby, said power switch means also including a transistor having a control terminal coupled to the output of said clocked data latch for switching said transistor between conductive and non-conductive states, said transistor including two additional terminals coupled to said electrical power source and to said second receiver, respectively, for electrically coupling said electrical power source to said second receiver when said transistor is switched to its conductive state, said forced-state input of said clocked data latch receiving said enabling signal for forcing the output of said clocked data latch to a first state that renders said transistor conductive.

5. A security system as recited by claim 4 wherein said second receiver, after being electrically coupled to said electrical power source, generates at least one clocking signal a predetermined time after said enabling signal is generated, said second receiver means also generating at least one data signal representative of whether said second signal has been detected, and wherein said clocking signal and said data signal are provided to said clock input and to said data input of said clocked data latch, respectively, for causing the output of said clocked data latch to assume a state determined by said data signal when said clocking signal is generated and thereby control the conduction of said transistor.

6. A security system as recited by claim 4 wherein said second signal is transmitted as a plurality of serially coded bits following transmission of each periodic pulse of said first signal, said serially coded bits being transmitted by said transmitter during a corresponding plurality of successive code bit intervals, said second receiver being adapted to receive said serially coded bits when said receiver means is brought into the vicinity of said exit, and wherein said second receiver includes processing means for providing a clocking signal to the clock input of said clocked data latch to distinguish each of said plurality of code bit intervals, said processing means storing a pattern of code bits and comparing the serially coded bit received during each code bit interval with a corresponding stored code bit to determine whether they match one another, said processing means providing a data signal to the data input and said clocked data latch for each code bit interval, said data signal being representative of whether, for a particular code bit interval, the serially coded received bit matched the corresponding stored code bit, said clocking signal and said data signal causing the output of said clocked data latch to assume a state determined by the status of said data signal when the clocking signal is generated and thereby decoupling said second receiver from said electrical power source substantially immediately after the occurrence of a code bit interval in which the serially coded received bit does not match the corresponding stored code bit.

7. A security system as recited by claim 6 wherein said first and second signals are transmitted as electromagnetic radio waves of first and second frequencies and wherein said first receiver includes a filter for passing signals of said first frequency and said second receiver includes a filter for passing signals of said second frequency.

8. A security system as recited by claim 7 wherein said second receiver includes synchronizing means responsive to said enabling signal for generating timing signals provided to said processing means, said processing means being responsive to said timing signals to distinguish between each of said plurality of successive code bit intervals.

9. A security system as recited by claim 8 wherein said synchronizing means includes:

a. a master clock for generating a periodic master clock signal having a frequency greater than the first frequency of said first signal;

b. a synch-pulse generator having a clock terminal for receiving said master clock signal, an output terminal for providing a synch-pulse, and a forced-state terminal coupled to said first receiver and responsive to said enabling signal, said synch-pulse generator causing said output terminal to assume a first state upon initial receipt of said enabling signal and causing said output terminal to assume a second state upon the receipt of the master clock signal next following the initial receipt of said enabling signal; and c. timing means coupled to said master clock for receiving said master clock signal and coupled to the output terminal of said synch-pulse generator and responsive to a change in the state thereof for timing the generation of said timing signals provided to said processing means.

10. A security system as recited by claim 9 wherein said master clock is a crystal oscillator.

11. A security system as recited by claim 9 wherein said synch-pulse generator includes:

a. a first clocked flip-flop having a clock input, a data input, a forced-state input and an output, the data input of said first clocked flip-flop being coupled to a source of a logic level tending to cause the output of said first clocked flip-flop to assume a first state when first clocked flip-flop is clocked, the forced-state input of said first clocked flip-flop being coupled to said forced-state terminal of said synch-pulse generator and causing the output of said first clocked flip-flop to assume a second state in response to the initial receipt of said enabling signal;

b. a second clocked flip-flop having a clock input, a data input, a forced-state input and an output, the data input of said second clocked flip-flop being coupled to the output of said first clocked flip-flop, the forced state input of said second clocked flip-flop being coupled to said forced-state terminal of said synch-pulse generator and causing the output of said second clocked flip-flop to assume a first state in response to the initial receipt of said enabling signal;

c. the clock inputs of each of said first and second clocked flip-flops being coupled to the clock terminal of said synch-pulse generator for receiving said master clock signal;

d. the output of said second clocked flip-flop assuming a second state opposite to the first state thereof upon receiving a master clock signal next following the occurrence of the initial receipt of said enabling signal, the output of said second clocked flip-flop returning to the first state thereof upon receipt of a second master clock signal next following the occurrence of the initial receipt of said enabling signal; and e. the output of said second clocked flip-flop being coupled to the output terminal of said synch-pulse generator for providing a pulse having a width equal to one period of the master clock following the initial receipt of said enabling signal.

12. A security system as recited by claim 7 wherein said processing means includes:

a. a microprocessor having a plurality of instruction input terminals for receiving a multiple-bit instruction code representative of an operation to be performed by said microprocessor, said microprocessor further including at least one bi-directional data port for receiving data and transmitting data and including a clock terminal for receiving a first timing signal to synchronize the performance of operations within said microprocessor and to synchronize the receipt of data by and the transmission of data from said microprocessor;

b. an addressable memory having a plurality of address input terminals for receiving an address and having a plurality of output terminals at least some of which are coupled to the instruction input terminals of said microprocessor for providing an instruction code thereto;

c. an address counter having a clock terminal for receiving a second timing signal, said address counter having a plurality of output terminals at least some of which are coupled to the address input terminals of said addressable memory for providing an address thereto, said address counter causing the address provided by the output terminals thereof to be sequentially modified each time said second timing signal is received by the clock terminal of said address counter;

d. timing means for generating said first and second timing signals; and e. coupling means for selectively coupling said second filter to the bi-directional data port of said microprocessor during each code bit interval for allowing said microprocessor to compare the serially coded bit received during a particular code bit interval to a corresponding stored code bit.

13. A security system as recited by claim 12 wherein:

a. said microprocessor includes a pulse output terminal for generating a pulse upon receiving a first instruction code at its instruction input terminals;

b. said addressable memory is programmed to provide said first instruction code during each of the plurality of code bit intervals; and c. said pulse output terminal is coupled to the clock input of said clocked data latch for providing said clocking signal thereto for each code bit interval.

14. A security system as recited by claim 13 wherein said microprocessor also includes a write output for signaling the operation of writing data on the bi-directional data port and wherein said processing means further includes a clocked flip-flop having an output and having a data input, said data input of said clocked flip-flop being coupled to the bi-directional data port of said microprocessor, said clocked flip-flop also having a clock input coupled to the write output of said microprocessor for clocking data presented to the data input thereof to the output thereof, the output of said clocked flip-flop being coupled to the data input of said clocked data latch for providing said data signal thereto.

15. A security system as recited by claim 14 wherein:

a. said microprocessor includes a further output terminal for generating a further signal upon receiving a second instruction code at its instruction input terminals;

b. said addressable memory is programmed to provide said second instruction code after receiving all of the plurality of serially coded bits transmitted by said transmitter;

c. said processing means includes a correct code latch circuit having a trigger input coupled to said further output terminal of said microprocessor, said correct code latch also including an output which changes its state when said further signal is received at the trigger input thereof; and d. said clocked flip-flop includes a forced-state input coupled to the output of said correct code latch circuit, said forced-state input causing the output of said clocked flip-flop to permanently assume a state which, when coupled to the data input of said clocked data latch and clocked therein, causes said transistor of said power switch means to remain conductive.

16. A security system as recited by claim 12 wherein said address counter is incremented by said second timing signal and wherein said address counter includes a reset input terminal for initializing the address provided by the output terminals thereof, said address counter further including a high-order output terminal for providing a trigger signal when said address counter is incremented to a predetermined number, said predetermined number being greater than the number of times said second timing signal is received by the clock terminal of said address counter within said first predetermined period between pulses of said first signal, said security system further including reset circuitry for applying a reset pulse to the reset input terminal of said address counter each said first signal is detected by said first receiver to initialize the output terminals of said address counter, said reset pulse preventing said trigger signal from occurring so long as said first signal is detected by said first receiver and thereby holding off the triggering of the alarm until said receiver is removed from the vicinity of said exit.

17. A security system as recited by claim 12 wherein:

(a) said addressable memory includes a data terminal for providing data representative of stored code bits therein, said addressable memory including at least one selector output terminal for providing a selector signal; and (b) said coupling means includes a first input terminal coupled to the data terminal of said addressable memory for receiving the stored code bits, a second input terminal coupled to said filter for receiving the serially coded bit received during a particular code bit interval, a third input terminal for receiving said selector signal, and an output terminal coupled to the bidirectional data port of said microprocessor for selectively coupling the stored code bits and the received serially coded bits to said microprocessor.

18. A security system as recited by claim 7 wherein said transmitter includes:

(a) clocking means for generating first and second clocking signals of said first and second frequencies, said clocking means also generating a third clocking signal having a period equal to the duration of one of said code bit intervals;

(b) a counter responsive to said third clocking signal for providing a periodically incremented code address;

(c) pattern generator means responsive to said periodically incremented code address for providing first and second gating signals, said second gating signal incorporating the serially coded bit pattern to be transmitted by said second signal;

(d) gating means having first and second inputs for receiving said first and second clocking signals, respectively, and having third and fourth inputs for receiving said first and second gating signals, respectively, and having a summing output, said gating means selectively coupling said first clocking signal to said summing output under the control of said first gating signal and selectively coupling said second clocking signal to said summing output under the control of said second gating signal, said summing output providing a summed output signal;

(e) an amplifier coupled to said summing output for amplifying the summed output signal and providing an amplified signal; and (f) means coupled to said amplifier and responsive to said amplified signal for radiating said first and second electromagnetic radio waves.

19. A security system as recited by claim 18 wherein:

(a) the summing output of said gating means provides the summed output signal as a voltage which switches between first and second nonnegative voltage levels relative to ground potential;

(b) said security system includes level translation means coupled to said amplifier for shifting the summed output signal to a bipolar signal switching between positive and negative voltage levels relative to ground potential; and (c) said security system further includes zero level control means responsive to said first and second gating signals for selectively causing the input of said amplifier to assume a voltage substantially equal to ground potential whenever both said first and second gating signals decouple said first and second clocking signals, respectively, from said summing output, in order to minimize power consumed by said amplifier when neither the first nor the second clocking signals are coupled to said amplifier.

20. A security system as recited by claim 19 wherein:

(a) said amplifier includes an operational amplifier having inverting and non-inverting input terminals and an output terminal, said non-inverting terminal being coupled to a source of ground potential and said inverting terminal being coupled by a feedback network to the output terminal thereof;

(b) said gating means including a first resistor coupled between the summing output thereof and the inverting terminal of said operational amplifier for providing the summed output signal;

(c) said level translation means comprises a current sink for withdrawing current of a predetermined magnitude from the inverting terminal of said operational amplifier; and (d) said zero level control means comprises a switchable current source responsive to said first and second gating signals for sourcing a current to the inverting terminal of said operational amplifier, the sourced current being of a first magnitude approximately equal to said predetermined magnitude for substantially inhibiting said level translation means when neither the first nor the second clocking signals are coupled to said amplifier, the sourced current being switched to a second magnitude when either of said first or second gating signals couples said first or second clocking signals to said amplifier, said second magnitude being substantially smaller than said first magnitude.

* * * * *

UNITED STATES PATENT AND TRADEMARK OFFICE

CERTIFICATE OF CORRECTION

PATENT NO. : 4,511,888

DATED : April 16, 1985

INVENTOR(S) : Bernhardt

It is certified that error appears in the above-identified patent and that said Letters Patent are hereby corrected as shown below:

Column 2, line 32 "cirucit" should read --circuit--;

Column 10, line 23, "4" should read --64--;

Column 12, line 16, "pulsed signal" should read --reference numeral--.

In the drawings, sheet 2, Fig. 2, the term "Q" within block 76 should read --$\overline{Q}$ --;

The term "Q" in block 78 should read --$Q_p$--;

The term "R" at the left end of block 78 should read --$Q_M$--;

Within block 82, the output terminal coupled to conductor 140 should be designated --RTN--;

Arrowheads should be added to the input terminal designated "C" within block 44 and to the input terminals designated "R", "C", and "D" within block 40.

UNITED STATES PATENT AND TRADEMARK OFFICE

CERTIFICATE OF CORRECTION

PATENT NO. : 4,511,888

DATED : April 16, 1985

INVENTOR(S) : Bernhardt

It is certified that error appears in the above-identified patent and that said Letters Patent are hereby corrected as shown below:

In the drawings, sheet 3, Fig. 3, the reference numeral --56-- should be added directed to the envelope of the topmost A form at the first positive excursion; at the first positive excursion of the second waveform, reference numeral --104-- should be added directed to the envelope, and the reference numeral --102-- should be added directed to the wavy lines below the envelope; wavy lines like those under the envelope of the second waveform at the first positive excursion should be inserted under the envelope at each of the other positive excursions of the second waveform.

Signed and Sealed this

*Twenty-ninth* Day of *October 1985*

[SEAL]

*Attest:*

*Attesting Officer*

DONALD J. QUIGG

*Commissioner of Patents and Trademarks—Designate*